US012146114B2

(12) United States Patent
Waynick et al.

(10) Patent No.: US 12,146,114 B2
(45) **Date of Patent: *Nov. 19, 2024**

(54) COMPOSITION AND METHOD OF MANUFACTURING AND USING EXTREMELY RHEOPECTIC SULFONATE-BASED GREASES

(71) Applicant: NCH Corporation, Irving, TX (US)

(72) Inventors: J. Andrew Waynick, Lantana, TX (US); Alisha Farrington, Irving, TX (US); Deon Copeland, McKinney, TX (US)

(73) Assignee: NCH Corporation, Irving, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/135,232

(22) Filed: Apr. 17, 2023

(65) Prior Publication Data

US 2023/0340354 A1 Oct. 26, 2023

Related U.S. Application Data

(63) Continuation of application No. 16/787,868, filed on Feb. 11, 2020, now Pat. No. 11,661,563.

(51) Int. Cl.
*C10M 135/10* (2006.01)
*C10M 105/80* (2006.01)
(Continued)

(52) U.S. Cl.
CPC ..... *C10M 105/80* (2013.01); *C10M 135/10* (2013.01); *C10M 171/005* (2013.01);
(Continued)

(58) Field of Classification Search
CPC ..... C10M 105/80; C10M 135/10; C10M 171/005; C10M 177/00; C10M 2219/0463;
(Continued)

(56) References Cited

U.S. PATENT DOCUMENTS 2,270,577 A 1/1942 Bergstrom
2,402,325 A 6/1946 Griesinger
(Continued)

FOREIGN PATENT DOCUMENTS

CN 101153239 4/2008
CN 101993767 3/2011
(Continued)

OTHER PUBLICATIONS

Boner, C.J., Manufacture and Application of Lubricating Greases, Hafner Publishing Company, Inc., 1954, p. 357, 369.
(Continued)

*Primary Examiner* — Taiwo Oladapo
(74) *Attorney, Agent, or Firm* — Scheef & Stone, LLP; Robin L. Barnes

(57) ABSTRACT

An extremely rheopectic sulfonate-based grease composition and method comprising adding overbased calcium sulfonate, overbased magnesium sulfonate, and a facilitating acid, using a particular type of overbased calcium sulfonate and/or methods for adding overbased calcium sulfonate relative to the magnesium sulfonate and facilitating acid to favor the reaction between the magnesium sulfonate and facilitating acid. A preferred overbased calcium sulfonate comprises benzene rings having multiple alkyl groups. Preferred methods comprise (1) adding all calcium sulfonate after adding the magnesium sulfonate and facilitating acid, (2) adding a first portion of calcium sulfonate with the magnesium sulfonate before adding the facilitating acid and a second portion of calcium sulfonate after the facilitating acid, and/or (3) one or more calcium sulfonate delay periods relative to adding the facilitating acid. The extremely rheopectic grease is fluid and pourable and only takes on a grease structure after milling or shearing.

24 Claims, 9 Drawing Sheets

(51) Int. Cl.
*C10M 171/00* (2006.01)
*C10M 177/00* (2006.01)
*C10N 50/10* (2006.01)

(52) U.S. Cl.
CPC .. *C10M 177/00* (2013.01); *C10M 2219/0463* (2013.01); *C10N 2050/10* (2013.01)

(58) Field of Classification Search
CPC ..... C10M 115/10; C10M 2219/0466; C10N 2050/10; C10N 2010/04; C10N 2030/02
See application file for complete search history.

(56) References Cited

U.S. PATENT DOCUMENTS 2,418,894 A 4/1947 McNab
2,444,970 A 7/1948 Zimmer
2,485,861 A 10/1949 Campbell
2,501,731 A 3/1950 Mertes
2,535,101 A 12/1950 Sproule
2,540,533 A 2/1951 Kolfenbach
2,585,520 A 2/1952 Van Ess
2,616,904 A 11/1952 Asseff
2,616,905 A 11/1952 Asseff
2,616,906 A 11/1952 Asseff
2,616,911 A 11/1952 Asseff
2,616,924 A 11/1952 Asseff
2,616,925 A 11/1952 Asseff
2,617,049 A 11/1952 Asseff
2,695,910 A 11/1954 Asseff
2,723,235 A 11/1955 Asseff
2,839,470 A 6/1958 Warren
2,861,951 A 11/1958 Carlyle
2,865,956 A 12/1958 Ellis
2,898,296 A 8/1959 Pattenden et al.
2,920,105 A 1/1960 Kluge
2,937,991 A 5/1960 Carlyle
2,940,930 A 6/1960 Pattenden et al.
2,956,018 A 10/1960 Carlyle
2,967,151 A 1/1961 Morway
2,977,301 A 3/1961 Bergen
2,978,410 A 4/1961 Fullerton
3,027,325 A 3/1962 McMillen
3,057,896 A 10/1962 Schlicht et al.
3,150,088 A 9/1964 Hunt et al.
3,186,944 A 6/1965 Dreher
3,242,079 A 3/1966 McMillen
3,372,114 A 3/1968 Rense
3,372,115 A 3/1968 McMillen
3,376,222 A 4/1968 McMillen
3,377,283 A 4/1968 McMillen
3,475,335 A 10/1969 Greene et al.
3,492,231 A 1/1970 McMillen
3,537,996 A 11/1970 Holst
3,629,109 A 12/1971 Karn et al.
3,655,558 A 4/1972 Geyer et al.
3,661,622 A 5/1972 Rogers
3,671,012 A 6/1972 Scott
3,679,584 A 7/1972 Hellmuth
3,681,242 A 8/1972 Gilani et al.
3,746,643 A 7/1973 Rogers
3,758,407 A 9/1973 Harting
3,791,973 A 2/1974 Gilani et al.
3,816,310 A 6/1974 Hunt
3,850,823 A 11/1974 Kjonaas
3,907,691 A 9/1975 King et al.
3,929,650 A 12/1975 King et al.
3,940,339 A 2/1976 Clarke, Jr. et al.
4,129,589 A 12/1978 Eliades et al.
4,297,227 A 10/1981 Witte et al.
4,376,060 A 3/1983 Stadler
4,435,299 A 3/1984 Carley et al.
4,444,669 A 4/1984 Wittse, Jr. et al.
4,483,775 A 11/1984 Yamaguchi
4,560,489 A 12/1985 Muir
4,597,880 A 7/1986 Eliades
4,728,578 A 3/1988 Higgins et al.
4,744,920 A 5/1988 Fischer et al.
4,780,224 A 10/1988 Jao
4,787,992 A 11/1988 Waynick
4,810,396 A 3/1989 Jao et al.
4,810,398 A 3/1989 Van Kruchten et al.
4,824,584 A 4/1989 Muir
4,830,767 A 5/1989 Waynick
4,902,435 A 2/1990 Waynick
4,904,399 A 2/1990 Waynick
4,929,371 A 5/1990 Waynick
5,084,193 A 1/1992 Waynick
5,126,062 A 6/1992 Barnes
5,190,678 A 3/1993 Swartz
5,308,514 A 5/1994 Olson
5,338,467 A 8/1994 Olson et al.
5,484,542 A 1/1996 Cahoon et al.
5,885,942 A 3/1999 Zhang et al.
6,172,122 B1 1/2001 Lawate et al.
6,239,083 B1 5/2001 Muir
6,432,889 B1 8/2002 Kinoshita et al.
6,534,450 B1 3/2003 Harrison et al.
6,596,672 B1 7/2003 Carrick et al.
6,869,111 B2 3/2005 Goto et al.
6,875,731 B1 4/2005 Bence
7,241,723 B2 7/2007 Zhang
7,294,608 B2 11/2007 Oldiges
7,517,837 B2 4/2009 Kurosky et al.
9,273,265 B2 3/2016 Waynick
9,458,406 B2 10/2016 Waynick
9,976,101 B2 5/2018 Waynick
9,976,102 B2 5/2018 Waynick
10,087,387 B2 10/2018 Waynick
10,087,388 B2 10/2018 Waynick et al.
10,087,391 B2 10/2018 Waynick
2003/0111838 A1 6/2003 Goto et al.
2003/0134756 A1 7/2003 Carrick et al.
2004/0214732 A1 10/2004 Oldiges et al.
2004/0235679 A1 11/2004 Kurosky et al.
2005/0054541 A1 3/2005 Zhang et al.
2005/0215442 A1 9/2005 Sivik et al.
2006/0025317 A1 2/2006 Olson et al.
2006/0223719 A1 10/2006 Riff et al.
2007/0060485 A1 3/2007 Waynick
2009/0305920 A1 12/2009 Kato et al.
2011/0021391 A1 1/2011 E et al.
2011/0048809 A1 3/2011 Duckworth
2011/0092404 A1 4/2011 Zhang et al.
2011/0136709 A1 6/2011 Tanaka et al.
2011/0160105 A1 6/2011 Tanaka et al.
2011/0190177 A1 8/2011 Zaki
2011/0195880 A1 8/2011 Kawamura et al.
2011/0233473 A1 9/2011 Fletcher
2012/0165235 A1 6/2012 Li et al.
2013/0109602 A1 5/2013 Waynick
2014/0121139 A1 5/2014 Waynick
2016/0115416 A1 4/2016 Waynick
2016/0230112 A1 8/2016 Waynick
2017/0335222 A1* 11/2017 Waynick ..... C10M 135/10
2017/0335229 A1* 11/2017 Waynick ..... C10M 177/00
2017/0369809 A1 12/2017 Capitosti
2019/0144776 A1 5/2019 Famg et al.
2020/0157459 A1 5/2020 Waynick et al.

FOREIGN PATENT DOCUMENTS

CN 102051257 5/2011
CN 102167991 8/2011
CN 102634400 8/2012
CN 104010972 8/2014
CN 104024162 9/2014
CN 104327906 2/2015
CN 104449959 3/2015
CN 103740435 6/2015
CN 103952215 11/2020
GB 816318 7/1959
GB 1239860 7/1971
JP 2003301190 10/2003

(56) References Cited

FOREIGN PATENT DOCUMENTS

| | | |
|---|---|---|
| JP | 2004346120 | 12/2004 |
| JP | 2007084620 | 4/2007 |
| JP | 2009286950 | 12/2009 |
| JP | 2009292918 | 12/2009 |
| JP | 2009298890 | 12/2009 |
| JP | 2016160356 | 9/2016 |
| WO | WO2011098616 | 8/2011 |
| WO | WO2013066952 | 5/2013 |
| WO | WO2013066955 | 5/2013 |
| WO | WO2015071331 | 5/2015 |

OTHER PUBLICATIONS

Bondi et al., Developments in the field of Soda Base Greases, Third World Petroleum Congress, The Hague, 1951, p. 373-395.

Smith, Gerould, The Phase Behavior of Soaps in Organic Solvents and its Relation to Lubricating Greases, The Journal of the American Oil Chemists' Society, Nov. 1947, p. 353-359.

Bradley-Shaw et al., Self-assembly and friction of glycerol monooleate and its hydrolysis products in bulk and confined non-aqueous solvents, Royal Society of Chemistry, Phys. Chem. Chem. Phys., 2018, 20, 17648-17657.

Kobylyanskli, E.V., Structure of Ultrabasic Sulfonate Greases, Chem. And Tech. of Fuels and Oils, 2002, 38(2), p. 110-114.

F. Cyriac, P.M. Lugt & R. Bosman (2016), Impact of Water on the Rheology of Lubricating Greases, Tribology Transactions, 59:4, 679-686, DOI: 10,1080/10402204.2015.1107929; https://doi.org/10.1080/10402004.2015.1107929.

* cited by examiner

COMPOSITION AND METHOD OF MANUFACTURING AND USING EXTREMELY RHEOPECTIC SULFONATE-BASED GREASES

CROSS-REFERENCE TO RELATED APPLICATION

This application is a continuation of U.S. application Ser. No. 16/787,868 filed on Feb. 11, 2020.

BACKGROUND OF THE INVENTION

1. Field of the Invention

This invention relates to sulfonate-based greases made with overbased calcium sulfonate and overbased magnesium sulfonate having extreme rheopectic properties wherein the composition is fluid and pumpable and only takes on a grease-like structure after milling or shearing.

2. Description of Related Art

Overbased calcium sulfonate greases have been an established grease category for many years. One known process for making such greases is a two-step process involving the steps of "promotion" and "conversion." Typically the first step ("promotion") is to react a stoichiometric excess amount of calcium oxide (CaO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases.

Typically the second step ("conversion") is to add a converting agent or agents, to the product of the promotion step, along with a suitable base oil (such as mineral oil) if needed to keep the initial grease from being too hard, to convert the amorphous calcium carbonate contained in the overbased calcium sulfonate to a very finely divided dispersion of crystalline calcium carbonate (calcite). Prior art converting agents include water and conventional non-aqueous converting agents, such as propylene glycol, isopropyl alcohol, formic acid or acetic acid. When acetic acid or other acids are used as a converting agent, typically water and another conventional non-aqueous converting agent (a third converting agent, such as an alcohol) are also used; alternatively only water (without the third converting agent) is added, but the conversion then typically occurs in a pressurized vessel. The most common conventional non-aqueous converting agents are mono-hydroxy or poly-hydroxy alcohols. Glycols (di-hydroxy alcohols) are one of the most often used of this family of conventional non-aqueous converting agents.

Because an excess of calcium hydroxide or calcium oxide is used to achieve overbasing, a small amount of residual calcium oxide or calcium hydroxide may also be present as part of the oil soluble overbased calcium sulfonate and will be dispersed in the initial grease structure. The extremely finely divided calcium carbonate formed by conversion, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

Conversion in overbased calcium sulfonate greases is typically determined by FTIR analysis. An FTIR spectrum showing a peak at 862 $cm^{-1}$ indicates the amorphous calcium carbonate contained in the overbased calcium sulfonate that will be converted to dispersed crystalline calcium carbonate. An intermediate peak at 874 $cm^{-1}$ is commonly observed during the conversion process of calcium sulfonate-based greases, at least when the conversion process occurs under open atmospheric pressure conditions. Depending on minor variations in the grease being made, this intermediate peak can be observed within the range of about 872 $cm^{-1}$ to 877 $cm^{-1}$. Complete conversion to the desirable dispersion of crystalline calcium carbonate (calcite) has typically been evidenced in the prior art by the elimination of the original amorphous calcium carbonate peak at 862 $cm^{-1}$ and any intermediate peak formed during the conversion process and the establishment of a new single peak at about 882 $cm^{-1}$.

In addition to simple calcium sulfonate greases, calcium sulfonate complex greases are also known in the prior art. These complex greases are typically produced by adding a strong calcium-containing base, such as calcium hydroxide or calcium oxide, to the simple calcium sulfonate grease produced by either the two-step or one-step process and reacting with up to stoichiometrically equivalent amounts of complexing acids, such as 12-hydroxystearic acid, boric acid, acetic acid (which may also be a converting agent when added pre-conversion), or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467. In making a complex calcium sulfonate grease, the complexing acids may be added directly or may be formed in-situ by adding any compound that would be expected to react with water to produce a short chain or long chain carboxylic acid that acts as a complexing acid. For example, as described in the U.S. Pat. No. 9,273,265, which is incorporated herein by reference, acetic anhydride can be added and will react with water to form acetic acid to be used as a complexing acid. Likewise, methyl 12-hydroxystearate can be added and will react with water to form 12-hydroxystearic acid to be used as a complexing acid.

Additionally, it is desirable to have a calcium sulfonate complex grease composition and method of manufacture that results in both improved thickener yield (by requiring a smaller percentage of overbased calcium sulfonate in the final grease) and dropping point. The term "thickener yield" as used herein refers to the concentration of the highly overbased oil-soluble calcium sulfonate required to provide a grease with a specific desired consistency as measured by the standard penetration tests ASTM D217 or D1403 commonly used in lubricating grease manufacturing. The term "dropping point" as used herein refers to the value obtained by using the standard dropping point test ASTM D2265 commonly used in lubricating grease manufacturing. Many of the known prior art compositions and methodologies require an amount of overbased calcium sulfonate of least 36% (by weight of the final grease product) to achieve a suitable grease in the NLGI No. 2 category with a demonstrated dropping point of at least 575 F. The overbased oil-soluble calcium sulfonate is one of the most expensive ingredients in making calcium sulfonate grease. Therefore it is desirable to reduce the amount of this ingredient while still maintaining a desirable level of firmness in the final grease (thereby improving thickener yield).

There are several known compositions and methods that result in improved thickener yield while maintaining a sufficiently high dropping point. For example, in order to achieve a substantial reduction in the amount of overbased calcium sulfonate used, many prior art references utilize a pressure reactor. It is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295), without requiring a pressure reactor. Higher dropping points are considered desirable since the dropping point is the first and most easily determined guide as to the high temperature utility limitations of a lubricating grease.

Overbased calcium sulfonate greases requiring less than 36% overbased calcium sulfonate are also achieved using the compositions and methods described in U.S. Pat. Nos. 9,273,265 and 9,458,406. The '265 and '406 patents teach the use of added crystalline calcium carbonate and/or added calcium hydroxyapatite (either with or without added calcium hydroxide or calcium oxide) as calcium-containing bases for reaction with complexing acids in making complex overbased calcium sulfonate greases. Prior to these patents, the known prior art always taught the use of calcium oxide or calcium hydroxide as the sources of basic calcium for production of calcium sulfonate greases or as a required component for reacting with complexing acids to form calcium sulfonate complex greases. The known prior art also taught that the addition of calcium hydroxide or calcium oxide needs to be in an amount sufficient (when added to the amount of calcium hydroxide or calcium oxide present in the overbased oil-soluble calcium sulfonate) to provide a total level of calcium hydroxide or calcium oxide sufficient to fully react with the complexing acids. The known prior art also generally taught that the presence of calcium carbonate (as a separate ingredient or as an "impurity" in the calcium hydroxide or calcium oxide, other than that presence of the amorphous calcium carbonate dispersed in the calcium sulfonate after carbonation), should be avoided for at least two reasons. The first being that calcium carbonate is generally considered to be a weak base, unsuitable for reacting with complexing acids to form optimum grease structures. The second being that the presence of unreacted solid calcium compounds (including calcium carbonate, calcium hydroxide or calcium oxide) interferes with the conversion process, resulting in inferior greases if the unreacted solids are not removed prior to conversion or before conversion is completed. However, as described in the '265 and '406 patents, Applicant has found that the addition of calcium carbonate as a separate ingredient (in addition to the amount of calcium carbonate contained in the overbased calcium sulfonate), calcium hydroxyapatite, or a combination thereof, either with or without added calcium hydroxide or calcium oxide, as ingredients for reacting with complexing acids produces a superior grease.

In addition to the '265 and '406 patents, there are a couple of prior art references that disclose the addition of crystalline calcium carbonate as a separate ingredient (in addition to the amount of calcium carbonate contained in the overbased calcium sulfonate), but those greases have poor thickener yield (as the prior art teaches) or require nano-sized particles of calcium carbonate. For example, U.S. Pat. No. 5,126,062 discloses the addition of 5-15% calcium carbonate as a separate ingredient in forming a complex grease, but also requires the addition of calcium hydroxide to react with complexing acids. The added calcium carbonate in the '062 patent is not the sole added calcium containing base for reacting with complexing acids as it is in the '265 patent. Additionally, the resulting NLGI No. 2 grease in the '062 patent contains 36%-47.4% overbased calcium sulfonate, which is a substantial amount of this expensive ingredient. In another example, Chinese publication CN101993767, discloses the addition of nano-sized particles of calcium carbonate (sized between 5-300 nm) being added to the overbased calcium sulfonate, although the reference does not indicate that the nano-sized particles of calcium carbonate are added as a reactant, or the sole separately added calcium containing base, for reacting with complexing acids. The use of nano-sized particles would add to the thickening of the grease to keep it firm, much like the fine dispersion of crystalline calcium carbonate formed by converting the amorphous calcium carbonate contained within the overbased calcium sulfonate (which can be around 20 A to 5000 A or around 2 nm to 500 nm according to the '467 patent), but would also substantially increase the costs over larger sized particles of added calcium carbonate. This Chinese patent application greatly emphasizes the absolute necessity of the added calcium carbonate having a true nano particle size. As shown in the example greases according to the invention described in the '265 patent, superior greases may be formed by the addition of micron sized calcium carbonate (preferably 1-20 microns) without requiring the use of the very expensive nano-sized particles when using added calcium carbonate as one of or the sole added calcium containing base for reacting with complexing acids.

There are also prior art references for using tricalcium phosphate as an additive in lubricating greases. For instance, U.S. Pat. Nos. 4,787,992; 4,830,767; 4,902,435; 4,904,399; and 4,929,371 all teach using tricalcium phosphate as an additive for lubricating greases. However, it is believed that prior to the '406 patent, no prior art references taught the use of calcium hydroxyapatite, having the formula $Ca_5(PO_4)_3OH$ or a mathematically equivalent formula with a melting point of around 1100 C (or excluding mixtures of tricalcium phosphate and calcium hydroxide), as a calcium-containing base for reaction with acids to make lubricating greases, including calcium sulfonate-based greases. There are several prior art references assigned to Showa Shell Sekiyu in Japan, including U.S. Patent Application Publication No. 2009/0305920, that describe greases containing tricalcium phosphate, $Ca_3(PO_4)_2$, and reference a "hydroxyapatite" having the formula $[Ca_3(PO_4)_2]_3 \cdot Ca(OH)_2$ as a source of tricalcium phosphate. This reference to "hydroxyapatite" is disclosed as a mixture of tricalcium phosphate and calcium hydroxide, which is not the same as the calcium hydroxyapatite disclosed and claimed in the '406 patent and herein having the formula $Ca_5(PO_4)_3OH$ or a mathematically equivalent formula with a melting point of around 1100 C. Despite the misleading nomenclature, calcium hydroxyapatite, tricalcium phosphate, and calcium hydroxide are each distinct chemical compounds with different chemical formulae, structures, and melting points. When mixed together, the two distinct crystalline compounds tricalcium phosphate ($Ca_3(PO_4)_2$) and calcium hydroxide ($Ca(OH)_2$) will not react with each other or otherwise produce the different crystalline compound calcium hydroxyapatite ($Ca_5(PO_4)_3OH$). The melting point of tricalcium phosphate (having the formula $Ca_3(PO_4)_2$) is 1670 C. Calcium hydroxide does not have a melting point, but instead loses a water molecule to form calcium oxide at 580 C. The calcium oxide thus formed has a melting point of 2580 C. Calcium hydroxyapatite (having the formula $Ca_5(PO_4)_3OH$ or a mathematically equivalent formula) has a melting point of around 1100 C. Therefore, regardless of how inaccurate the nomenclature may be, calcium hydroxyapatite is not the same chemical compound as tricalcium phosphate, and it is not a simple blend of tricalcium phosphate and calcium hydroxide.

In making overbased calcium sulfonate greases, much of the known prior art using the two step method teaches the addition of all converting agents (water and conventional non-aqueous converting agents) at the same time and usually prior to heating. However, U.S. Pat. Nos. 9,976,101 and 9,976,102, which are incorporated herein by reference, disclose a method where there is a delay between the addition of water and the addition of at least part of a conventional non-aqueous converting agent that results in improved thickener yield and dropping point. Prior to the '101 and '102 patents, a few prior art references disclose a time interval (although always poorly defined or not defined at all) between the addition of water and the addition of at least part of the conventional non-aqueous converting agent(s). For example, U.S. Pat. No. 4,560,489 discloses a process (examples 1-3) where base oil and overbased calcium carbonate are heated to around 150° F., then water is added, the mixture is then heated to around 190° F. before adding acetic acid and methyl Cellosolve (a highly toxic monomethylether of ethylene glycol). The resulting grease contains greater than 38% overbased calcium sulfonate and the '489 patent points out that the ideal amount of overbased calcium sulfonate for the processes disclosed therein is around 41-45%, since according to the '489 patent using less than 38% results in a soft grease. The resulting grease of example 1 in the '489 patent has a dropping point of around only 570° F. The '489 patent does not state the duration of delay between the addition of water and the addition of the conventional non-aqueous converting agents, but indicates that the addition was immediate after a period of heating from 150 F to just 190 F. The dropping point and thickener yield in the '489 patent are not desirable.

Additionally, U.S. Pat. Nos. 5,338,467 and 5,308,514 disclose the use of a fatty acid, such as 12-hydroxystearic acid, as a converting agent used along with acetic acid and methanol, where there is no delay for the addition of the fatty acid but some interval between the addition of water and the addition of acetic acid and methanol. Example B in the '514 patent and example 1 in the '467 patent both describe a process where water and the fatty acid converting agent are added to other ingredients (including the overbased calcium sulfonate and base oil), then heated to around 140-145° F. before adding acetic acid followed by methanol. The mixture is then heated to around 150-160° F. until conversion is complete. The amount of overbased calcium sulfonate in the final grease products in both examples is 32.2, which is higher than desirable. These patents do not state the duration of delay between the addition of water and fatty acid and the addition of the acetic acid and methanol, but indicates that the addition was immediate after an unspecified period of heating. Similar processes are disclosed in example A of the '467 patent and example C of the '514 patent except all of the fatty acid was added post conversion, so the only conventional non-aqueous converting agents used were the acetic acid and methanol added after the mixture with water was heated to 140-145 F. The amount of overbased calcium sulfonate in these examples is even higher than the previous examples at 40%. In addition to not achieving ideal thickener yield results, all these processes use methanol as a converting agent, which has environmental drawbacks. The use of volatile alcohols as converting agents may result in venting these ingredients to the atmosphere as a later part of the grease-making process, which is prohibited in many parts of the world. If not vented, the alcohols must be recovered by water scrubbing or water traps, which results in hazardous material disposal costs. As such, there is a need for a process that achieves better thickener yields, preferably without requiring the use of volatile alcohols as converting agents.

Better thickener yields are achieved in example 10 of the '514 patent, but the use of excess lime is taught as a requirement to achieve those results. In that example, water and excess lime are added together with other ingredients, the mixture is heated to 180-190 F while slowly adding acetic acid during the heating period. The resulting grease contained 23% overbased calcium sulfonate. While this thickener yield is better than others, there is still room for greater improvement without requiring the use of excess lime, which the '514 patent teaches as a requirement.

The other examples in '514 and '467 patents where there are thickener yields of 23% or less either involve the use of a pressurized kettle during conversion or are like the much greater part of the other prior art where there is no "delay" between the addition of water and the conventional non-aqueous converting agents or both. These examples involve adding water and a fatty acid converting agent, mixing for 10 minutes without heating, and then adding acetic acid, either in a pressurized kettle or without pressure. Neither of these patents recognizes any benefit or advantage to the 10 minute interval for adding acetic acid, or the other heating delays in the examples discussed above, rather these patents focus the use of a fatty acid as a converting agent and the benefits of adding the fatty acid pre-conversion, post-conversion, or both as the reason for any observed yield improvements. Additionally, as discussed below, this 10 minute mixing interval without any heating is not a "converting agent delay" as that term is used herein, but is considered to be the same as adding the ingredients at the same time, recognizing that adding each ingredient takes at least some time and cannot occur instantaneously.

The addition of alkali metal hydroxides in simple calcium soap greases, such as anhydrous calcium-soap thickened greases, is also known. But prior to the disclosure U.S. Pat. No. 9,976,102), which is incorporated herein by reference, it was not known to add an alkali metal hydroxide in a calcium sulfonate grease to provide improved thickener yield and high dropping point, because that addition would be considered unnecessary by one of ordinary skill in the art. The reason for adding an alkali metal hydroxide, such as sodium hydroxide, in simple calcium soap greases is that the usually used calcium hydroxide has poor water solubility and is a weaker base than the highly water soluble sodium hydroxide. Because of this, the small amount of sodium hydroxide dissolved in the added water is said to react quickly with the soap forming fatty acid (usually 12-hydroxystearic acid or a mixture of 12-hydroxystearic acid and a non-hydroxylated fatty acid such as oleic acid) to form the sodium soap. This quick reaction is thought to "get the ball rolling." However, the direct reaction of calcium-containing bases such as calcium hydroxide with fatty acids has never been a problem when making calcium sulfonate complex greases. The reaction occurs very easily, likely due to the high detergency/dispersancy of the large amount of calcium sulfonate present. As such, it is not known in the prior art to use an alkali metal hydroxide in a calcium sulfonate grease as a way to get the complexing acids to react with the calcium hydroxide.

Several other improvements in overbased calcium sulfonate greases have been disclosed in recent years. These include the addition of an overbased magnesium sulfonate to an overbased calcium sulfonate grease, including a delayed addition of magnesium sulfonate relative to the addition of water or one or more other reactive ingredients and/or a split addition of magnesium sulfonate, as described in U.S. Pat. No. 10,087,387 and the exclusion of conventional non-aqueous converting agents as described in U.S. Pat. No. 10,087,391. Another improvement is the use of a facilitating acid delay period as described in U.S. Pat. No. 10,087,388. The '388 patent teaches a delay between the addition of at least a portion of a facilitating acid and at least a portion of one other subsequently added ingredient to provide improvements in both thickener yield (requiring less overbased calcium sulfonate while maintaining acceptable penetration measurements) and expected high temperature utility as demonstrated by dropping point. The '388 patent also teaches that magnesium sulfonate may be the subsequently added ingredient in a facilitating acid delay period, and that a shorter delay without heating will still be considered a facilitating acid delay period because the magnesium sulfonate is reactive with the facilitating acid. Each of these patents is incorporated herein by reference. In all of these prior patents, the overbased calcium sulfonate is always added at the beginning (before or after base oil), before any facilitating acid, and there is no teaching or suggestion of adding all or a portion of the overbased calcium sulfonate after adding overbased magnesium sulfonate and/or a facilitating acid.

With a couple of exceptions, all known prior art sulfonate-based greases are rheopectic in that they have a thickened grease-like structure prior to milling, but milling provides increased dispersion and ordered structure to the thickener, resulting in a firmer grease consistency and providing a moderate increase in thickening. Such prior are greases all exhibit "normal" rheopectic behavior for sulfonate-based greases. One exception is disclosed in U.S. patent application Ser. No. 16/681,232, claiming the benefit of U.S. Provisional Application Ser. No. 62/769,704 filed Nov. 20, 2018. This application discloses the addition of a glycerol derivative to a sulfonate-based grease, which frequently results in a grease that does not require milling. Milling of these greases did not impart the moderate thickening found in typical sulfonate-based greases having normal rheopectic behavior, making these greases less rheopectic than normal or completely non-rheopectic (no significant further thickening upon milling).

Other exceptions are Example 27 disclosed in the '387 patent (which is identical to Example 12 in the '388 patent and Example 1 in the '391 patent) and Example 3 in the '391 patent, both of which had "extreme" rheopectic properties. Unlike normal rheopectic sulfonate-based greases, these extremely rheopectic greases were extremely fluid prior to milling and only took on a significant grease-like structure upon milling or shearing. Both of these examples used good quality overbased calcium sulfonate, overbased magnesium sulfonate, and added calcium carbonate as the sole calcium containing base (as described in the '265 patent), as did several other examples in the '387 patent, '388 patent, and '391 patent that did not result in an extremely rheopectic grease. The Example 27 grease used a converting agent delay method, but Example 3 did not use any conventional non-aqueous converting agent (and, thus, no converting agent delay method). Several other examples in the '387, '388, and '391 patents similarly used a converting agent delay method or did not use any conventional non-aqueous converting agents, but they did not result in an extremely rheopectic grease. The reason why the Example 27 and Example 3 greases were extremely rheopectic was not disclosed in the '387, '388, or '391 patents or even known at the time those applications were filed. As the extreme rheopectic property is beneficial for certain uses, there is a need for compositions and methods to create a sulfonate-based grease having such property.

SUMMARY OF THE INVENTION

This invention relates to sulfonate-based greases, particularly overbased calcium magnesium sulfonate greases, and methods for manufacturing such greases that are extremely rheopectic, being fluid-like upon manufacturing and taking on a grease-like structure only after milling or shearing. Without being bound by theory, it is believed that a primary cause of the extreme rheopectic behavior is the reaction product between the facilitating acid and overbased magnesium sulfonate. When DDBSA is used as a preferred facilitating acid, that reaction product is magnesium dodecylbenzene sulfonate. How this reaction product contributes to the extreme rheopectic behavior is not known, but the inventor discovered that using ingredients or methods that favor the reaction between the facilitating acid and the overbased magnesium sulfonate over the reaction between the facilitating acid and overbased calcium sulfonate will result in the extreme rheopectic behavior. One preferred way of favoring that reaction is to use specific types of overbased calcium sulfonates. Other preferred ways of favoring that reaction is use a split addition of overbased calcium sulfonate and/or a delayed addition of overbased calcium sulfonate relative to the addition of the facilitating acid.

According to one preferred embodiment, an extremely rheopectic sulfonate-based grease composition comprises an overbased calcium sulfonate having specific structures related to alkyl groups on the sulfonate benzene rings in the overbased calcium sulfonate. Such overbased calcium sulfonate can result in an extremely rheopectic grease without using a calcium sulfonate delay method or a calcium sulfonate split addition, although such overbased calcium sulfonate can also be used with a calcium sulfonate delay method and/or a calcium sulfonate split addition method. Most preferably, the overbased calcium sulfonate comprises benzene rings having more than one alkyl group. According to another preferred embodiment, the overbased calcium sulfonate comprises benzene rings that are sterically hindered or otherwise less reactive to the facilitating acid. According to another preferred embodiment, the overbased calcium sulfonate is a natural sulfonate, not a synthetic sulfonate. Without being bound by theory, it is believed these preferred types of overbased calcium sulfonates allow the facilitating acid to preferentially react with the overbased magnesium sulfonate relative to reacting with the overbased calcium sulfonate, which results in the desired extreme rheopectic behavior of the greases according to preferred embodiments of the invention of this application.

According to another preferred embodiment, an extremely rheopectic sulfonate-based grease is made by adding a first portion of an overbased calcium sulfonate, along with all or part of the overbased magnesium sulfonate, prior to adding a facilitating acid and a second portion of the overbased calcium sulfonate after adding the facilitating acid, referred to herein as a split addition of overbased calcium sulfonate. According to yet another preferred embodiment, an extremely rheopectic sulfonate-based grease is made by adding overbased magnesium sulfonate prior to adding a facilitating acid and adding all of the overbased calcium sulfonate after the facilitating acid. According to another preferred embodiment, there are one or more calcium sulfonate delay periods between the addition of the facilitating acid and the subsequent addition of all or the second portion of the overbased calcium sulfonate. These delay periods may be a temperature adjustment delay period and/or a holding delay period, similar to those described in U.S. Pat. No. 10,087,388.

According to another preferred embodiment, a calcium sulfonate delay period may be a calcium sulfonate temperature adjustment delay, where at least a portion of a facilitating acid is added to other ingredients to form a first mixture which is then heated or cooled prior to the addition of all or a portion of the overbased calcium sulfonate as the next ingredient added subsequent to the facilitating acid. According to another preferred embodiment, a calcium sulfonate delay may be a calcium sulfonate holding delay where the first mixture is held at a temperature or within a range of temperatures for a period of time of at least 20 minutes prior to the addition of all or a portion of the overbased calcium sulfonate as the next ingredient added subsequent to the facilitating acid.

According to another preferred embodiment, an extremely rheopectic sulfonate-based grease is made by combining the above described embodiments with a conventional non-aqueous converting agent delay as described in U.S. Pat. Nos. 9,976,101, 9,976,102, 10,087,387 and 10,087,388. For ease of reference, a delay period/method with respect to the addition of a conventional non-aqueous converting agent as described in these patents will be referred to as a converting agent delay period or converting agent delay method (or similar wording).

According to another preferred embodiment, an extremely rheopectic calcium magnesium sulfonate complex grease composition comprises between 10%-45% overbased calcium sulfonate and 0.1%-30% overbased magnesium sulfonate. Preferably, an extremely rheopectic calcium magnesium sulfonate complex grease composition according to an embodiment of the invention comprises between 10%-37% overbased calcium sulfonate and 1%-24% overbased magnesium sulfonate. More preferably, an extremely rheopectic calcium magnesium sulfonate complex grease composition according to an embodiment of the invention comprises between 10%-30% overbased calcium sulfonate and 1%-20% overbased magnesium sulfonate. Most preferably, an extremely rheopectic calcium magnesium sulfonate complex grease composition according to an embodiment of the invention comprises between 10%-22% overbased calcium sulfonate and 1%-15% overbased magnesium sulfonate.

According to another preferred embodiment, an extremely rheopectic calcium magnesium sulfonate grease comprises overbased calcium sulfonate and overbased magnesium sulfonate as ingredients in a ratio range of 99.9:0.1 to 60:40, more preferably in a ratio range of 99:1 to 70/30, and most preferably in a ratio range of 90:10 to 80:20. Other amounts of overbased magnesium sulfonate relative to the amount of overbased calcium sulfonate may also be used.

According to another preferred embodiment, an extremely rheopectic sulfonate-based grease composition comprises a glycerol derivative, as disclosed in U.S. patent application Ser. No. 16/681,232 filed on Nov. 12, 2019, claiming the benefit of U.S. Provisional Application Ser. No. 62/769,704 filed Nov. 20, 2018. The glycerol derivative may be added before or after the conversion process, or a portion added before conversion and a portion added after conversion.

According to another preferred embodiment, if a complex grease is desired, one or more complexing acids are also added, either before conversion, after conversion, or both. According to another preferred embodiment, added calcium carbonate is used as the sole added calcium containing base, as taught in the '265 patent. According to another preferred embodiment, calcium hydroxyapatite is used as a calcium containing base, as taught in the '406 patent. According to another preferred embodiment, calcium hydroxyapatite, added calcium hydroxide (or added calcium oxide) and added calcium carbonate are used as calcium containing bases.

BRIEF DESCRIPTION OF THE FIGURES

The composition and method of the invention are further described and explained in relation to the following drawings wherein.

DESCRIPTION OF THE PREFERRED EMBODIMENTS

Figure 1:
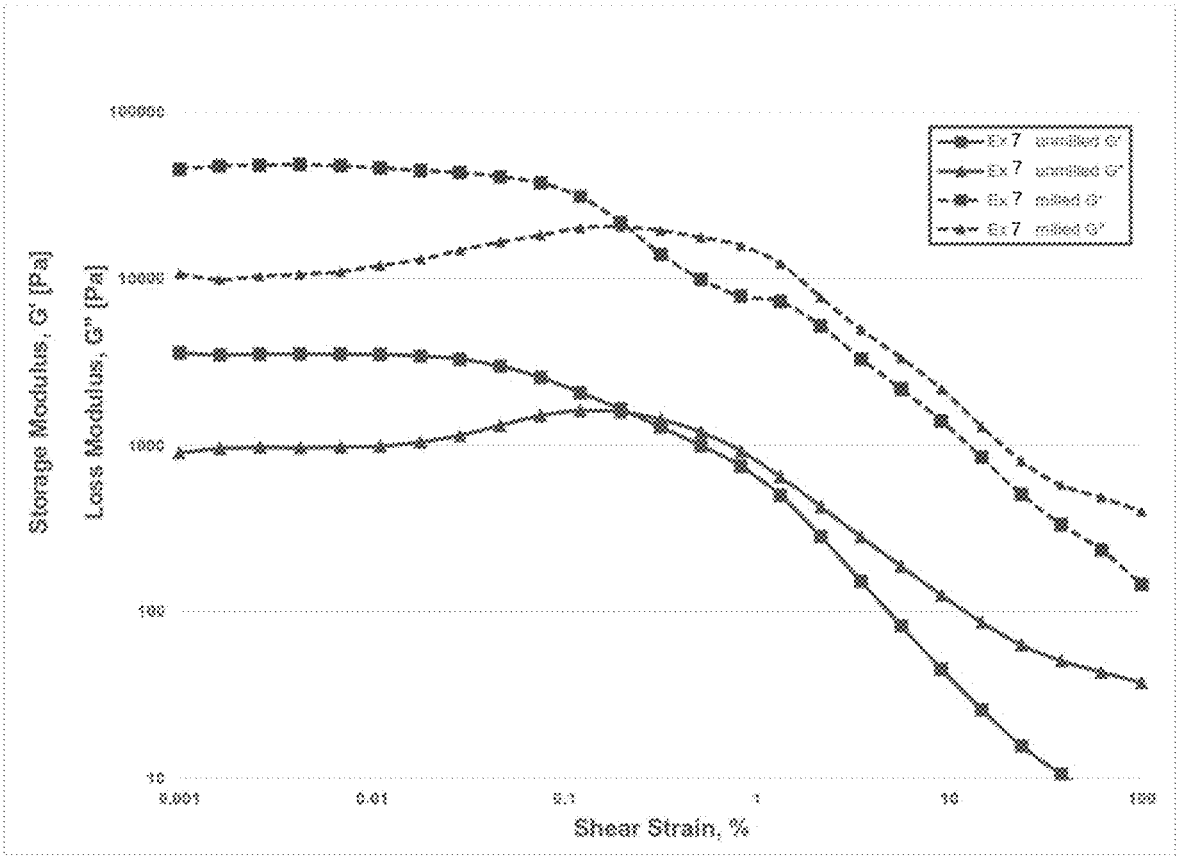
FIG. 1 is a graph showing results of an oscillatory rheometry amplitude sweep at 25 C of the Example 7 unmilled and milled greases.

Preferred embodiments of an extremely rheopectic sulfonate-based grease composition and methods for making such compositions are described herein. As used herein, extremely rheopectic refers to grease behavior that is substantially more rheopectic that what is considered normal rheopectic behavior for a sulfonate-based grease, and comprises one or more of the following: (1) any sulfonate-based grease composition that is essentially fluid and completely pourable prior to milling or shearing and only takes on a thickened grease structure after milling or shearing; (2) any sulfonate-based grease composition that has an unmilled, unworked penetration greater than 360, preferably greater than 380, more preferably greater than 400, and most preferably greater than 450; (3) any sulfonate-based grease composition that has an unmilled worked 60 stroke penetration value that is less than (harder than) its unmilled unworked penetration value, more preferably more than 20 points less and most preferably more than 50 points less; and/or (4) any sulfonate-based grease composition that is Newtonian prior to milling or shearing, but takes on a non-Newtonian grease structure upon milling or shearing.

Methods of Making Sulfonate-Based Greases

It is noted that the extreme rheopectic behavior observed in some examples of the '387 and '391 patents has never been known to occur with overbased calcium sulfonate greases (made without the addition of overbased magnesium sulfonate), but only with certain overbased calcium magnesium sulfonate greases as described in the '387 and '391 patents. It is believed that a primary cause of the extreme rheopectic behavior is the reaction product between the facilitating acid and magnesium sulfonate. When DDBS is used as a preferred facilitating acid, that reaction product is magnesium dodecylbenzene sulfonate. Other facilitating acids would result in other reaction products that would be expected to achieve the same behavior. Because the detailed structure of calcium sulfonate-based greases (even calcium sulfonate-based greases with normal rheology) is not well understood, how this reaction product contributes to the extreme rheopectic behavior is not known, but it appears the formed magnesium dodecylbenzene sulfonate (or other reaction product depending on the facilitating acid used) is somehow incorporated into the structure of the calcium sulfonate complex thickener in such a way as to eliminate most or virtually all of the grease structure until mechanical energy imparts a large amount of non-Newtonian structure. The inventor has discovered that using ingredients or methods that favor the reaction between the facilitating acid and the overbased magnesium sulfonate over the reaction between the facilitating acid and overbased calcium sulfonate will result in the extreme rheopectic behavior. One preferred way of favoring that reaction is to use specific types of overbased calcium sulfonates. Other preferred ways of favoring that reaction are to use a calcium sulfonate split addition and/or a calcium sulfonate delayed addition method.

According to one preferred embodiment, a method of making an extremely rheopectic sulfonate-based simple or complex grease comprises adding a specific type of overbased calcium sulfonate. All known overbased calcium sulfonates have mixture of molecular structures related to the alkyl groups on the benzene rings, which may be mono-alkylated, di-alkylated, or have a higher number of alkyl groups. The inventor has discovered that using certain types of overbased calcium sulfonates results in an extremely rheopectic sulfonate-based grease. Most preferably, a method of making an extremely rheopectic sulfonate-based simple or complex grease comprises adding an overbased calcium sulfonate that (a) comprises benzene rings with more than one alkyl group, (b) is a natural sulfonate, (c) comprises benzene rings that are sterically hindered, or (d) a combination thereof. For ease of reference, this is referred to herein as a multiple alkyl group overbased calcium sulfonate addition/method. It is not required that overbased calcium sulfonates used in these preferred embodiments exclude mono-alkylated benzene rings or non-sterically hindered benzene rings, only that the overbased calcium sulfonate comprise some di-alkylated or higher benzene rings and/or some sterically hindered benzene rings so that the reaction between the facilitating acid and overbased magnesium sulfonate is favored over the reaction with the overbased calcium sulfonate. It will be understood to anyone with ordinary skill in the art that all overbased calcium sulfonates will comprise a range of alkyl groups in terms of both the length of the alkyl chains on the benzene ring and the number of alkyl chains on the benzene ring. Therefore, preferred overbased calcium sulfonate structures in term of alkyl groups on the benzene ring will necessarily be defined by degrees in a continuum instead of sharp separations. Keeping that distinction in mind, most preferably, overbased calcium sulfonates used in the multiple alkyl group addition method primarily comprise benzene rings having multiple alkyl groups and/or that are sterically hindered, by having at least 30% of the benzene rings with multiple alkyl groups and/or that are sterically hindered, more preferably at least 50%, and most preferably at least 70%. According to another preferred embodiment, overbased calcium sulfonates used in the multiple alkyl group addition method preferably comprise benzene rings wherein at least 5% of the benzene rings having tri-alkylated or higher groups, more preferably at least 10%, and most preferably at least 15%. This multiple alkyl group overbased calcium sulfonate addition embodiment may be used with a calcium sulfonate split addition method and/or a calcium sulfonate delayed addition method, but is not required to be used with either method. Most preferably, all of the overbased magnesium sulfonate is added prior to the facilitating acid in this multiple alkyl group overbased calcium sulfonate addition embodiment. Additionally, it is most preferred to not use a facilitating acid delay method where all of the overbased magnesium sulfonate is the next subsequently added ingredient in combination with a multiple alkyl group overbased calcium sulfonate addition embodiment.

According to another preferred embodiment, an extremely rheopectic simple or complex sulfonate-based grease is made by mixing overbased magnesium sulfonate with a first portion of an overbased calcium sulfonate, then adding a facilitating acid, and then adding a second portion of the overbased calcium sulfonate. An initial portion of the total added base oil may be added at any point in this process. This is referred to herein as a split addition of the overbased calcium sulfonate or a calcium sulfonate split addition.

According to another preferred embodiment of the invention, an extremely rheopectic simple or complex sulfonate-based grease is made by mixing overbased magnesium sulfonate with a facilitating acid prior to adding any overbased calcium sulfonate.

According to another preferred embodiment, there are one or more calcium sulfonate delay periods between the addition of the facilitating acid and all or a portion of the calcium sulfonate. This is referred to herein as a calcium sulfonate delay period. A calcium sulfonate delay period is a period of time between the addition of a facilitating acid and the addition of all or a portion of the overbased calcium sulfonate. Most preferably, a calcium sulfonate delay period comprises adding the overbased calcium sulfonate as the next subsequently added ingredient after the facilitating acid, with no other ingredients added between the two; however, another ingredient may be added between the facilitating acid and the calcium sulfonate provided such ingredient is added after sufficient time for the previously added facilitating acid to have reacted with the overbased magnesium sulfonate. Alternatively, all or a portion of the overbased magnesium sulfonate may be added after the facilitating acid and prior to adding all of the overbased calcium sulfonate. Any ingredient added after the facilitating acid has reacted with the overbased magnesium sulfonate should not negatively impact formation of the reaction product (e.g. magnesium dodecylbenzene sulfonate) that contributes to the extreme rheopectic behavior. A calcium sulfonate delay may be a calcium sulfonate temperature adjustment delay period or a calcium sulfonate holding delay period or both, similar to the converting agent delays previously described. Because the calcium sulfonate delay period is relative to the facilitating acid, it is also considered a facilitating acid delay period as described in the '388 patent. However, prior to the invention disclosed herein, there is no known prior art (including the '388 patent) that teaches or suggests adding all or a portion of the overbased calcium sulfonate after the facilitating acid.

A calcium sulfonate temperature adjustment delay period is the amount of time after one or more facilitating acids is added that it takes to heat the mixture to a temperature or range of temperatures before adding all or a portion of the overbased calcium sulfonate. A calcium sulfonate holding delay period is the amount of time the mixture comprising the facilitating acid is held at a temperature (which may be ambient temperature) or range of temperatures before (1) adding all or a portion of the overbased calcium sulfonate or (2) being heated or cooled to another temperature before adding all or a portion of the overbased calcium sulfonate. A delay between the addition of a facilitating acid and all or a portion of the calcium sulfonate of that is long enough for complete reaction between the facilitating acid and the overbased magnesium sulfonate is a calcium sulfonate delay period. The reaction between the facilitating acid and overbased magnesium sulfonate occurs very rapidly and, depending on batch size, may be completed in less than 5 minutes or less than 10 minutes. Such short time periods are calcium sulfonate delay periods, as are longer delays of 20 minutes or more, regardless of whether there is any heating during delay.

In preferred embodiments using a calcium sulfonate split addition and/or calcium sulfonate delay addition, a method for making an extremely rheopectic sulfonate-based grease comprises: (1) adding and mixing all or a part of the overbased magnesium sulfonate and a base oil; (2) adding and mixing overbased calcium sulfonate, wherein (a) a calcium sulfonate split addition is used by adding a first portion of the overbased calcium sulfonate before the facilitating acid and a second portion after the facilitating acid, (b) all of the overbased calcium sulfonate is added after the facilitating acid, (c) there is one or more calcium sulfonate delay periods between the addition of the facilitating acid and all or a portion of the overbased calcium sulfonate, or (d) a combination thereof; (3) adding and mixing a facilitating acid; (4) adding and mixing one or more calcium containing bases; (5) adding and mixing one or more converting agents (water and optionally a conventional non-aqueous converting agent); (6) adding and mixing one or more complexing acids (when a complex grease is desired); (7) heating some combination of these ingredients until conversion has occurred. In these preferred embodiments, any overbased calcium sulfonate may be used. The addition of calcium containing bases in step 4 and complexing acids in step (6) may take place prior to conversion or after conversion or a portion of either or both ingredients may be added prior to conversion and another portion added after conversion.

In preferred embodiments using a multiple alkyl group overbased calcium sulfonate addition, a method for making an extremely rheopectic sulfonate-based grease comprises: (1) mixing overbased calcium sulfonate and a base oil, wherein the overbased calcium sulfonate preferably (a) comprises benzene rings with more than one alkyl group, (b) is a natural sulfonate, (c) comprises benzene rings that are sterically hindered, or (d) a combination thereof; (2) adding and mixing all or part of the overbased magnesium sulfonate, preferably all of the overbased magnesium sulfonate being added prior to adding a facilitating; (3) adding and mixing a facilitating acid; (4) adding and mixing one or more calcium containing bases; (5) adding and mixing one or more converting agents (water and optionally a conventional non-aqueous converting agent); (6) adding and mixing one or more complexing acids (when a complex grease is desired); (7) heating some combination of these ingredients until conversion has occurred. In this preferred embodiment (1) all of the overbased magnesium sulfonate is preferably added before the facilitating acid or (2) a facilitating acid delay where magnesium sulfonate is the next subsequently added ingredient is not used. The addition of calcium containing bases in step 4 and complexing acids in step (6) may take place prior to conversion or after conversion or a portion of either or both ingredients may be added prior to conversion and another portion added after conversion.

In these embodiments, it is important that sufficient overbased magnesium sulfonate be present when the facilitating acid is added that the facilitating acid will react with the overbased magnesium sulfonate. For example, in the multiple alkyl group addition method, if the facilitating acid is added to a sufficient amount of the overbased calcium sulfonate before adding the overbased magnesium sulfonate, the facilitating acid will react quickly and fully with overbased calcium sulfonate and an extremely rheopectic grease will not be formed. However, if a sufficient amount of overbased magnesium sulfonate is present when the facilitating acid is added, even if the specific types of overbased calcium sulfonate outlined above is also present when the facilitating acid is added, the facilitating acid will preferentially react with the overbased magnesium sulfonate and an extremely rheopectic grease will be formed.

Any of the above embodiments may be modified by or used with any one or more of the following additional steps or ingredients: (a) by adding overbased magnesium sulfonate all at once prior to conversion; (b) adding magnesium sulfonate using a split addition method; (c) using a magnesium sulfonate delay period; (d) using a combination of split addition and magnesium sulfonate delay period(s); (e) using one or more facilitating acid delay periods (where the next subsequently added ingredient is not overbased calcium sulfonate and is preferably not overbased magnesium sulfonate when a multiple alkyl group overbased calcium sulfonate embodiment is used); (f) without adding any conventional non-aqueous converting agents prior to conversion; (g) the addition of calcium hydroxyapatite and/or added calcium carbonate as calcium-containing bases for reacting with complexing acids, either with or without separately adding added calcium hydroxide and/or added calcium oxide as calcium containing bases; (h) the addition of an alkali metal hydroxide (most preferably sodium hydroxide); (i) the delayed addition of conventional non-aqueous converting agents; or (j) adding and mixing a one or more glycerol derivatives. These additional methods and ingredients are disclosed in U.S. Pat. Nos. 9,458,406, 9,273,265, 9,976,101, 9,976,102, 10,087,387, 10,087,388, and 10,087,391, and U.S. application Ser. No. 16/681,232 filed on Nov. 12, 2019, which claims the benefit of U.S. Provisional Application Ser. No. 62/769,704 filed Nov. 20, 2018, which are incorporated herein by reference.

The complexing acids in step (6) may be separately added complexing acids or may be a complexing acid formed in situ by reaction of an added glycerol derivative and water. All or a portion of one or more glycerol derivatives may be added prior to conversion or after conversion or any combination thereof. Most preferably, if a glycerol derivative is added, at least a portion of a glycerol derivative is added prior to conversion.

Most preferably, a converting agent delay period is used with preferred methods of the invention. A converting agent delay used in some preferred embodiments is a period of time between the initial pre-conversion addition of water and pre-conversion addition of at least a portion of a non-aqueous converting agent. A converting agent delay period may be a converting agent temperature adjustment delay period or a converting agent holding delay period or both. If additional water is added pre-conversion to make up for evaporation losses during the manufacturing process, those additions are not used in re-starting or determining converting agent delay periods, and only the first addition of water is used as the starting point in determining converting agent delay periods. A converting agent temperature adjustment delay period is the amount of time after the initial water is added that it takes to heat the mixture to a temperature or range of temperatures. A converting agent holding delay period is the amount of time the mixture is held at a temperature (including ambient temperature) before being heated or cooled to another temperature or before adding at least a portion of a non-aqueous converting agent. There may be multiple converting agent temperature adjustment delay periods and multiple converting agent holding delay periods or a combination thereof. For example, the mixture comprising the initial water may be held at ambient temperature for 30 minutes prior to adding one non-aqueous converting agent (a first holding delay period) and may continue to be held at ambient temperature for another hour prior to adding the same or a different non-aqueous converting agent (a second holding delay period). Additionally, the mixture comprising the initial water may be heated or cooled to a first temperature after which a non-aqueous converting agent is added (a first temperature adjustment period) and then the mixture is heated or cooled to a second temperature after which the same or a different non-aqueous converting agent is added (a second temperature adjustment period, without any interim holding period). Although a converting agent delay period may involve a holding delay period that does not involve heating, a short period of time of less than 15 minutes between the addition of the initial water as a converting agent and the addition of all of the non-aqueous converting agent(s) without any heating during that time period is not a "converting agent delay" or "converting agent delay period" as used herein. A delay for the addition of any or all of the non-aqueous converting agent(s) without heating during the delay period should be at least about 20 minutes and more preferably at least about 30 minutes.

The calcium containing bases and complexing acids can be added prior to conversion, after conversion, or a portion added prior and another portion added after conversion. If alkali metal hydroxide are is added, the facilitating acid, overbased magnesium sulfonate, and at least a portion of the overbased calcium sulfonate are preferably added to the mixture before the alkali metal hydroxide is added. Most preferably, the specific ingredients and amounts used in the methods of the invention are according to the preferred embodiments of the compositions described herein. Although some ingredients are preferably added prior to other ingredients, the order of addition of most ingredients relative to other ingredients in the preferred embodiments of the invention is not critical, with the exception of when a calcium sulfonate split addition method, calcium sulfonate delay method, converting agent delay method, or any other split addition or delay method is used and with the exception of preferably not adding magnesium sulfonate as the next subsequently added ingredient in a facilitating acid delay when using a multiple alkyl group overbased calcium sulfonate embodiment.

One or more optional additional steps may be used with the calcium sulfonate split addition, calcium sulfonate delayed addition, and/or multiple alkyl group overbased calcium sulfonate addition methods according to preferred embodiments of the invention. These optional additional steps comprise: (8) mixing and heating to a temperature sufficiently high to ensure removal of water; (9) optionally mixing additional base oil, as needed, after conversion; (10) mixing and heating to a temperature sufficiently high to insure removal of any volatile reaction byproducts and optimize final product quality; (11) cooling the grease while adding additional base oil as needed; and (12) adding remaining desired additives as are well known in the art. Although the order and timing of final steps 8-12 is not critical, it is preferred that water be removed quickly after conversion. Generally, the grease is heated to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly.

If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

The preferred embodiments of the methods herein may occur in either an open or closed kettle as is commonly used for grease manufacturing. The conversion process can be achieved at normal atmospheric pressure or under pressure in a closed kettle. Manufacturing in open kettles (vessels not under pressure) is preferred since such grease manufacturing equipment is commonly available. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium magnesium sulfonate greases, as will be understood by those with ordinary skill in the art. Manufacturing in pressurized kettles may also be used and may result in even greater improvement in thickener yield, but the pressurized processes may be more complicated and difficult to control. Additionally, manufacturing calcium magnesium sulfonate greases in pressurized kettles may result in productivity issues. The use of pressurized reactions can be important for certain types of greases (such as polyurea greases) and most grease plants will only have a limited number of pressurized kettles available. Using a pressurized kettle to make calcium magnesium sulfonate greases, where pressurized reactions are not as important, may limit a plant's ability to make other greases where those reactions are important. These issues are avoided with open vessels.

Sulfonate-Based Grease Compositions

According to one preferred embodiment of the invention, an extremely rheopectic simple or complex sulfonate-based grease comprises overbased calcium sulfonate, overbased magnesium sulfonate, one or more converting agents (preferably water and optionally one or more separately added conventional non-aqueous converting agents), and at least one facilitating acid. According to another preferred embodiment, a sulfonate-based complex grease composition further comprises base oil, one or more added calcium containing bases, and one or more complexing acids.

According to one preferred embodiment, an extremely rheopectic grease composition comprises an overbased calcium sulfonate comprising benzene rings having multiple alkyl groups and/or sterically hindered benzene rings. According to another preferred embodiment, any overbased calcium sulfonate may be used with certain methods to produce an extremely rheopectic grease.

According to several preferred embodiments, an extremely rheopectic sulfonate-based grease composition, with a conventional non-aqueous converting agent or without a conventional non-aqueous converting agent, comprises the following ingredients by weight percent of the final grease product (although some ingredients, such as water, acids, and calcium containing bases, may not be in the final grease product or may not be in the concentrations indicated for addition):

TABLE 1A

Preferred Sulfonate-Based Grease Compositions when a Conventional Non-Aqueous Converting Agent is Used

| Ingredient name | Preferred (%) | More Preferred (%) | Most Preferred (%) |
|---|---|---|---|
| Overbased Calcium Sulfonate | 10-45 | <37 | <30 (or even more preferably <22) |
| Overbased Magnesium Sulfonate | <30 | <24 | <20 (or even more preferably <15) |
| Base Oil (total) | 30-70 | 45-70 | 50-70 |
| Water (added) | 1.5-10 | 2.0-5.0 | 2.2-4.5 |
| Conventional non-aqueous converting agent | 0.1-5 | 0.3-4.0 | 0.5-2.0 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 0-20 | 0-15 | 0-10 |
| Calcium carbonate (added) | 0-20 | 0-15 | 0-10 |
| Calcium hydroxide (added) and/or calcium oxide (added) (total amount if both used) | 0-1.20 | 0-1.00 | 0-0.80 |
| Total complexing acids (separately added) | 1.25-18.0 | 2.2-12.0 | 3.5-8.5 |
| Short Chain acids | 0.05-2.0 | 0.1-1.0 | 0.15-0.5 |
| Long Chain Acids | 0.5-8.0 | 1.0-5.0 | 2.0-4.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

TABLE 1B

Preferred Sulfonate-Based Grease Compositions when No Conventional Non-Aqueous Converting Agent is Used

| Ingredient name | Preferred (%) | More Preferred (%) | Most Preferred (%) |
|---|---|---|---|
| Overbased Calcium Sulfonate | 10-45 | <37 | <33 (or even more preferably <28) |
| Overbased Magnesium Sulfonate | <30 | <24 | <20 (or even more preferably <15) |
| Base Oil (total) | 30-70 | 40-70 | 45-70 |

TABLE 1B-continued

| Preferred Sulfonate-Based Grease Compositions when No Conventional Non-Aqueous Converting Agent is Used | | | |
|---|---|---|---|
| Ingredient name | Preferred (%) | More Preferred (%) | Most Preferred (%) |
| Water (added) | 1.5-10 | 2.0-5.0 | 2.2-4.5 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 0-20 | 0-15 | 0-10 |
| Calcium carbonate (added) | 0-20 | 0-15 | 0-10 |
| Calcium hydroxide (added) and/or calcium oxide (added) (total amount if both used) | 0-1.60 | 0-1.20 | 0-1.00 |
| Total complexing acids (separately added) | 1.25-20.0 | 2.2-15.0 | 3.5-9.5 |
| Short Chain acids | 0.05-2.0 | 0.1-1.0 | 0.15-0.5 |
| Long Chain Acids | 0.5-10.0 | 1.0-8.0 | 2.0-5.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

Other preferred amounts are contained in the other tables and Examples herein and in the other U.S. Patent documents incorporated herein by reference. Some or all of any particular ingredient, including converting agents, added calcium containing bases, and glycerol derivatives may not be in the final finished product due to evaporation, volatilization, or reaction with other ingredients during manufacture. These amounts are when a grease is made in an open vessel. Even smaller amounts of overbased calcium sulfonate may be used when a sulfonate-based grease is made in a pressure vessel.

When a calcium sulfonate split addition method and/or a calcium sulfonate delayed addition method are used according to preferred embodiments of the invention, the highly overbased oil-soluble calcium sulfonate (also referred to herein as simply "calcium sulfonate" or "overbased calcium sulfonate" for brevity) used to make a sulfonate-based grease can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400 or higher. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation.

When a calcium sulfonate split addition method and/or a calcium sulfonate delayed addition method are not used according to preferred embodiments of the invention, the overbased calcium sulfonate preferably (1) comprises benzene rings with more than one alkyl group, (2) is a natural sulfonate, (3) comprises benzene rings that are sterically hindered, or (4) a combination thereof. It is not required that overbased calcium sulfonates used in these preferred embodiments exclude mono-alkylated benzene rings or non-sterically hindered benzene rings, only that the overbased calcium sulfonate comprise some di-alkylated or higher benzene rings and/or some sterically hindered benzene rings so that the reaction between the facilitating acid and overbased magnesium sulfonate is favored over the reaction with the overbased calcium sulfonate. It will be understood to anyone with ordinary skill in the art that all overbased calcium sulfonates will comprise a range of alkyl groups in terms of both the length of the alkyl chains and the number of alkyl chains. Therefore, preferred overbased calcium sulfonate structures in term of alkyl groups on the benzene ring will necessarily be defined by degrees in a continuum instead of sharp separations. Keeping that distinction in mind, most preferably, overbased calcium sulfonates used in the multiple alkyl group addition method primarily comprise benzene rings having multiple alkyl groups and/or that are sterically hindered, by having at least 30% of the benzene rings with multiple alkyl groups and/or that are sterically hindered, more preferably at least 50%, and most preferably at least 70%. According to another preferred embodiment, overbased calcium sulfonates used in the multiple alkyl group addition method preferably comprise benzene rings wherein at least 5% of the benzene rings having tri-alkylated or higher groups, more preferably at least 10%, and most preferably at least 15%. These overbased calcium sulfonates may also be used with a calcium sulfonate split addition method and/or a calcium sulfonate delayed addition method according to other preferred embodiments.

The overbased calcium sulfonate used in any of these embodiments contains around 28% to 40% dispersed amorphous calcium carbonate by weight of the overbased calcium sulfonate, which is converted to crystalline calcium carbonate during the process of making the calcium sulfonate grease. The overbased calcium sulfonate also contains around 0% to 8% residual calcium oxide or calcium hydroxide by weight of the overbased calcium sulfonate. Most commercial overbased calcium sulfonates will also contain around 40% base oil as a diluent, to keep the overbased calcium sulfonate from being so thick that it is difficult to handle and process. The amount of base oil in the overbased calcium sulfonate may make it unnecessary to add additional base oil (as a separate ingredient) prior to conversion to achieve an acceptable grease.

The overbased calcium sulfonate used in any of these embodiments may be of a "good" quality or a "poor" quality as in the '406 patent and defined herein. Certain overbased oil-soluble calcium sulfonates marketed and sold for the manufacture of calcium sulfonate-based greases can provide products with unacceptably low dropping points when some prior art calcium sulfonate technologies are used. Such overbased oil-soluble calcium sulfonates are referred to as "poor quality" overbased oil-soluble calcium sulfonates throughout this application. When all ingredients are the same except for the commercially available batch of overbased calcium sulfonate used, overbased oil-soluble calcium sulfonates producing greases using the calcium carbonate technology of the '265 patent having higher dropping points (above 575 F) are considered to be "good" quality calcium sulfonates for purposes of this invention and those producing greases having lower dropping points are considered to be "poor" quality for purposes of this invention. Several examples of this are provided in the '406 patent, which is incorporated by reference. Although comparative chemical analyses of good quality and poor quality overbased oil-soluble calcium sulfonates has been performed, it is believed that the precise reason for this low dropping point problem has not been proven. While many commercially available overbased calcium sulfonates are considered to be good quality, it is desirable to achieve both improved thickener yield and higher dropping points regardless of whether a good quality or a poor quality calcium sulfonate is used.

The overbased magnesium sulfonate (also referred to herein as simply "magnesium sulfonate," for brevity) used according to these embodiments of the invention for a calcium magnesium sulfonate grease can be any typical to that documented or known in the prior art. The overbased magnesium sulfonate may be made in-situ or any commercially available overbased magnesium sulfonate may be used. Overbased magnesium sulfonate will typically comprise a neutral magnesium alkylbenzene sulfonate and an amount of overbasing wherein a substantial amount of that overbasing is in the form of magnesium carbonate. The magnesium carbonate is believed to typically be in an amorphous (non-crystalline) form. There may also be a portion of the overbasing that is in the form of magnesium oxide, magnesium hydroxide, or a mixture of the oxide and hydroxide. The total base number (TBN) of the overbased magnesium sulfonates is preferably at least 400 mg KOH/gram, but lower TBN values may also be acceptable and in the same ranges as indicated for the TBN values for the overbased calcium sulfonate above.

According to another preferred embodiment, a calcium magnesium sulfonate grease comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20. According to another preferred embodiment, a pre-conversion sulfonate-based grease composition comprises the following ingredients: overbased calcium sulfonate, overbased magnesium sulfonate, water, and optional base oil, and wherein water is the sole conventional converting agent in the pre-conversion composition. According to another preferred embodiment, a pre-conversion sulfonate-based grease composition comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20.

Any petroleum-based naphthenic or paraffinic mineral oils commonly used and well known in the grease making art may be used as the base oil according to the invention. Base oil is added as needed, since most commercial overbased calcium sulfonates will already contain about 40% base oil as a diluent so as to prevent the overbased sulfonate from being so thick that it cannot be easily handled. Similarly, overbased magnesium sulfonate will likely contain base oil as a diluent. With the amount of base oil in the overbased calcium sulfonate and overbased magnesium sulfoante, it may be unnecessary to add additional base oil depending on the desired consistency of the grease immediately after conversion as well as the desired consistency of the final grease. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) is preferably in the ranges indicated in Tables 1A-3B, based on the final weight of the grease. Typically, the amount of base oil added as a separate ingredient will increase as the amount of overbased calcium sulfonate decreases. Combinations of different base oils as described above may also be used in the invention, as will be understood by those with ordinary skill in the art.

Sulfonate-based greases according to preferred embodiments also comprise a small amount of a facilitating acid, which is added to the mixture prior to conversion. Suitable facilitating acids, such as an alkyl benzene sulfonic acid, preferably having an alkyl chain length typically between 8 to 16 carbons, may help to facilitate efficient grease structure formation. When an alkyl benzene sulfonic acid is used as a facilitating acid, it preferably comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. Other suitable facilitating acids preferably comprise one or more of (1) tartaric acid, citric acid, muccic acid, citramalic acid, isopropylmalic acid, gluconic acid, malic acid, oxalic acid, succinic acid, glutaric acid, adipic acid, pimelic acid, suberic acid, azelaic acid, sebacic acid, 1,11-undecanedicarboxylic acid, or 1,12-dodecanedicarboxylic acid; (2) alkyl derivatives or esters of succinic, adipic, glutaric acids, or 3,3-dimethyl pentanedioic acids; (3) reaction products of an olefin and a glyoxylic acid or derivatives thereof; (4) copolymers derived from an olefin and an unsaturated dicarboxylic acid, preferably maleic acid; or (5) an inorganic acid, preferably phosphoric or sulfuric acids. When a facilitating acid is used in the present invention, it is preferably added before conversion and preferably in an amount in the ranges indicated in Tables 1A-3B. If the calcium sulfonate or magnesium sulfonate is made in situ using alkyl benzene sulfonic acid, the facilitating acid added according to this embodiment is in addition to that required to produce the calcium sulfonate.

Water is added to the preferred embodiments of the invention as one converting agent. One or more conventional non-aqueous converting agents is also preferably added in certain embodiments of the invention. The conventional non-aqueous converting agents include any previously known converting agent other than water, such as alcohols, ethers, glycols, glycol ethers, glycol polyethers, carboxylic acids, inorganic acids, organic nitrates, other polyhydric alcohols and their derivatives, and any other compounds that contain either active or tautomeric hydrogen. Conventional non-aqueous converting agents also include those agents that contain some water as a diluent or impurity. Although they may be used as conventional non-aqueous converting agents, it is preferred not to use alcohols, such as methanol or isopropyl alcohol or other low molecular weight (i.e. more volatile) alcohols, because of environmental concerns and restrictions related to venting gases during the grease manufacturing process or hazardous waste disposal of scrubbed alcohols. The total amount of water added as a converting agent, based on the final weight of the grease, is preferably in the ranges indicated in Tables 1A-3B. Additional water may be added after conversion. Also, if the conversion takes place in an open vessel at a sufficiently high temperature so as to volatilize a significant portion of the water during conversion, additional water may be added to replace the water that was lost. The total amount of one or more conventional non-aqueous converting agents added, based on the final weight of the grease, is preferably in the ranged indicated in Tables 1A, 2A, and/or 3A. Typically, the amount of conventional non-aqueous converting agent used will decrease as the amount of overbased calcium sulfonate decreases. Depending on the converting agents used, some or all of them may be removed by volatilization during the manufacturing process. Especially preferred are the lower molecular weight glycols such as hexylene glycol and propylene glycol. It should be noted that some converting agents may also serve as complexing acids, to produce a calcium sulfonate complex grease according to one embodiment of the invention, discussed below. Such materials will simultaneously provide both functions of converting and complexing.

According to another preferred embodiment, conventional non-aqueous converting agents, which are typically added to calcium sulfonate greases, are not used as ingredients. Such conventional non-aqueous converting agents include alcohols, ethers, glycols, glycol ethers, glycol polyethers, and other polyhydric alcohols and their derivatives. These ingredients may be added after conversion is complete, if desired, within the scope of such preferred embodiments of the invention since they will not act as converting agents if added after conversion; however, it is preferred that they be omitted altogether in these preferred embodiments.

One or more alkali metal hydroxides are also optionally added as ingredients in a preferred embodiment of sulfonate-based grease compositions according to the invention. The optional added alkali metal hydroxides comprise sodium hydroxide, lithium hydroxide, potassium hydroxide, or a combination thereof. Most preferably, sodium hydroxide is the alkali hydroxide used with the sulfonate-based greases according to one embodiment of the invention. The total amount of alkali metal hydroxide added is preferably in the ranges indicated in the Tables and Examples herein. As with the calcium-containing bases, the alkali metal hydroxide reacts with complexing acids resulting in an alkali metal salt of a complexing acid present in the final grease product. The preferred amounts indicated in the Tables and Examples herein are amounts added as raw ingredients relative to the weight of the final grease product, even though no alkali metal hydroxide will be present in the final grease.

One or more calcium containing bases are also added as ingredients in preferred embodiments of sulfonate-based grease compositions according to the invention. These calcium containing bases react with complexing acids to form a complex calcium magnesium sulfonate grease. The calcium containing bases may include calcium hydroxyapatite, added calcium carbonate, added calcium hydroxide, added calcium oxide, or a combination of one or more of the foregoing. According to one preferred embodiment, added calcium carbonate may be used as the sole added calcium containing base, as described in the '265 patent. The preferred amounts of ingredients when calcium carbonate is the sole added calcium containing base, with or without any conventional non-aqueous converting agent, according to these embodiments is in the following tables. The amounts are by weight percent of the final grease product (although these bases and other ingredients will not be present in the final grease product).

TABLE 2A

Sulfonate Based Greases Using Calcium Carbonate and a Conventional Non-Aqueous Converting Agent

| Ingredient name | Preferred % | More Preferred % | Most Preferred % |
|---|---|---|---|
| Overbased Calcium Sulfonate | 10-45 | <37 | <30 (or even more preferably <22) |
| Overbased Magnesium Sulfonate | <30 | <24 | <20 (or even more preferably <15) |
| Base Oil (total) | 30-70 | 45-70 | 50-70 |
| Water (added) | 1.5-10 | 2.0-5.0 | 2.2-4.5 |
| Conventional non-aqueous converting agent | 0.1-5 | 0.3-4.0 | 0.5-2.0 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium carbonate (added as sole added calcium containing base) | 1.0-20 | 2.0-15 | 3.0-10 |
| Total complexing acids | 1.25-18.0 | 2.2-12.0 | 3.5-8.5 |
| Short Chain acids | 0.05-2.0 | 0.1-1.0 | 0.15-0.5 |
| Long Chain Acids | 0.5-8.0 | 1.0-5.0 | 2.0-4.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

TABLE 2B

| Sulfonate-Based Greases Using Calcium Carbonate and No Conventional Non-Aqueous Converting Agent | | | |
|---|---|---|---|
| Ingredient name | Preferred % | More Preferred % | Most Preferred % |
| Overbased Calcium Sulfonate | 10-45 | <37 | <33 (or even more preferably <28) |
| Overbased Magnesium Sulfonate | <30 | <24 | <20 (or even more preferably <15) |
| Base Oil (total) | 30-70 | 40-70 | 45-70 |
| Water (added) | 1.5-10 | 2.0-5.0 | 2.2-4.5 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium carbonate (added as sole added calcium containing base) | 1.0-20 | 2.0-15 | 3.0-10 |
| Total complexing acids | 1.25-20.0 | 2.2-15.0 | 3.5-9.5 |
| Short Chain acids | 0.05-2.0 | 0.1-1.0 | 0.15-0.5 |
| Long Chain Acids | 0.5-10.0 | 1.0-8.0 | 2.0-5.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

According to another preferred embodiment, calcium hydroxyapatite is added as a calcium containing base as described in the '406 patent. Most preferably added calcium hydroxyapatite and added calcium carbonate are used together, along with a small amount of added calcium hydroxide. The preferred amounts of ingredients when calcium hydroxyapatite is added as a calcium containing base (preferably with added calcium carbonate and added calcium hydroxide), with or without any conventional non-aqueous converting agent, according to these embodiments is in the following tables. The amounts are by weight percent of the final grease product (although these bases and other ingredients will not be present in the final grease product).

TABLE 3A

| Sulfonate-Based Greases Using Calcium Hydroxyapatite and a Conventional Non-Aqueous Converting Agent | | | |
|---|---|---|---|
| Ingredient name | Preferred % | More Preferred % | Most Preferred % |
| Overbased Calcium Sulfonate | 10-45 | <37 | <30 (or even more preferably <22) |
| Overbased Magnesium Sulfonate | <30 | <24 | <20 (or even more preferably <15) |
| Base Oil (total) | 30-70 | 45-70 | 50-70 |
| Water (added) | 1.5-10 | 2.0-5.0 | 2.2-4.5 |
| Conventional non-aqueous converting agent | 0.1-5 | 0.3-4.0 | 0.5-2.0 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 1.0-20 | 2.0-15 | 3.0-10 |
| Calcium carbonate (added) | 1.0-20 | 2.0-15 | 3.0-10 |
| Calcium hydroxide (added) and/or calcium oxide (added) (total amount if both used) | 0.07-1.20 | 0.15-1.00 | 0.18-0.80 |
| Total complexing acids | 1.25-18.0 | 2.2-12.0 | 3.5-8.5 |
| Short Chain acids | 0.05-2.0 | 0.1-1.0 | 0.15-0.5 |
| Long Chain Acids | 0.5-8.0 | 1.0-5.0 | 2.0-4.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

TABLE 3B

| Sulfonate-Based Greases Using Calcium Hydroxyapatite and No Conventional Non-Aqueous Converting Agent | | | |
|---|---|---|---|
| Ingredient name | Preferred % | More Preferred % | Most Preferred % |
| Overbased Calcium Sulfonate | 10-45 | <37 | <33 (or even more preferably <28) |
| Overbased Magnesium Sulfonate | <30 | <24 | <20 (or even more preferably <15) |
| Base Oil (total) | 30-70 | 40-70 | 45-70 |
| Water (added) | 1.5-10 | 2.0-5.0 | 2.2-4.5 |

TABLE 3B-continued

| Sulfonate-Based Greases Using Calcium Hydroxyapatite and No Conventional Non-Aqueous Converting Agent | | | |
|---|---|---|---|
| Ingredient name | Preferred % | More Preferred % | Most Preferred % |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 1.0-20 | 2.0-15 | 3.0-10 |
| Calcium carbonate (added) | 1.0-20 | 2.0-15 | 3.0-10 |
| Calcium hydroxide (added) and/or calcium oxide (added) (total amount if both used) | 0.07-1.60 | 0.15-1.20 | 0.18-1.00 |
| Total complexing acids | 1.25-20.0 | 2.2-15.0 | 3.5-9.5 |
| Short Chain acids | 0.05-2.0 | 0.1-1.0 | 0.15-0.5 |
| Long Chain Acids | 0.5-10.0 | 1.0-8.0 | 2.0-5.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

The calcium containing base(s) for reacting with complexing acids according to preferred embodiments may be added pre-conversion, post-conversion, or a portion added pre- and a portion added post-conversion.

The added calcium carbonate used as a calcium containing base, either alone (as described in the '265 patent) or in combination with another calcium containing base or bases (such as calcium hydroxyapatite), according to these embodiments of the invention, is finely divided with a mean particle size of around 1 to 20 microns, preferably around 1 to 10 microns, most preferably around 1 to 5 microns. Furthermore, the added calcium carbonate is preferably crystalline calcium carbonate (most preferably calcite) of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of added calcium carbonate added is preferably in the ranges indicated in Tables and Examples herein, particularly Tables 2A and 2B. These amounts are added as a separate ingredient in addition to the amount of dispersed calcium carbonate contained in the overbased calcium sulfonate. According to another preferred embodiment of the invention, the added calcium carbonate is added prior to conversion as the sole added calcium-containing base ingredient for reacting with complexing acids. Additional calcium carbonate may be added to either the simple or complex grease embodiments of the invention after conversion, and after all reaction with complexing acids is complete in the case of a complex grease. However, references to added calcium carbonate herein refer to the calcium carbonate as one of, or the sole, added calcium-containing base(s) for reaction with complexing acids when making a complex grease according to the invention.

The calcium hydroxyapatite added according to preferred embodiments is most preferably finely divided with a mean particle size of around 1 to 20 microns, preferably around 1 to 10 microns, most preferably around 1 to 5 microns. Furthermore, the calcium hydroxyapatite will be of sufficient purity so as to have abrasive contaminants such as silica and alumina at a level low enough to not significantly impact the anti-wear properties of the resulting grease. Ideally, for best results, the calcium hydroxyapatite should be either food grade or U.S. Pharmacopeia grade. The amount of calcium hydroxyapatite added will preferably be in the ranges indicated in Tables and Examples herein, particularly Tables 3A and 3B, although more can be added, if desired, after conversion and all reaction with complexing acids is complete.

According to another preferred embodiment of the invention, calcium hydroxyapatite may be added in an amount that is stoichiometrically insufficient to fully react with the complexing acids. In this embodiment, finely divided calcium carbonate as an oil-insoluble, solid, added calcium-containing base may be added, preferably before conversion, in an amount sufficient to fully react with and neutralize the portion of any subsequently added complexing acids not neutralized by the calcium hydroxyapatite. Alternatively, in this embodiment, finely divided calcium hydroxide and/or calcium oxide as an oil-insoluble solid calcium-containing base may be added, preferably before conversion, in an amount sufficient to fully react with and neutralize the portion of any subsequently added complexing acids not neutralized by the co-added calcium hydroxyapatite. According to yet another preferred embodiment, a combination of added calcium carbonate and added calcium hydroxide (or calcium oxide) are used when the amount of calcium hydroxyapatite is stoichiometrically insufficient.

According to yet another preferred embodiment, when calcium hydroxyapatite is used in combination with added calcium hydroxide as calcium containing bases for reacting with complexing acids to make a calcium magnesium sulfonate grease, a smaller amount of calcium hydroxyapatite is needed compared to the calcium sulfonate greases described in the '406 patent. In the '406 patent, the added calcium hydroxide and/or calcium oxide are preferably present in an amount not more than 75% of the hydroxide equivalent basicity provided by the total of the added calcium hydroxide and/or calcium oxide and the calcium hydroxyapatite. In other words, the calcium hydroxyapatite contributes preferably at least 25% of the total added hydroxide equivalents (from both calcium hydroxyapatite and added calcium hydroxide and/or added calcium oxide) in the calcium sulfonate greases described in the '406 patent, particularly when a poor quality overbased calcium sulfonate is used. If less than that amount of calcium hydroxyapatite is used, the dropping point of the final calcium sulfonate grease may suffer. However, with the addition of overbased magnesium sulfonate to the composition according to various embodiments of this invention, less calcium hydroxyapatite may be used while still maintaining sufficiently high dropping points. The amount of calcium hydroxyapatite used according to preferred embodiments of this invention may be less than 25%, and even less than 10% of the hydroxide equivalent basicity, even when a poor quality overbased calcium sulfonate is used. This is one indication that the presence of overbased magnesium sulfonate in the finished grease has resulted in an unexpected changed and improved chemical structure. Since calcium hydroxyapatite is typically much more costly compared to added calcium hydroxide, this results in a further potential cost reduction for the final grease without any significant reduction in dropping point.

In another embodiment, calcium carbonate may also be added with the calcium hydroxyapatite, calcium hydroxide and/or calcium oxide, with the calcium carbonate being added either before or after reacting with complexing acids, or added both before and after reacting with complexing acids. When the amounts of calcium hydroxyapatite, calcium hydroxide, and/or calcium oxide are not sufficient to neutralize the complexing acid or acids added, calcium carbonate is preferably added in an amount that is more than sufficient to neutralize any remaining complexing acid or acids.

The added calcium hydroxide and/or added calcium oxide added pre-conversion or post-conversion according to another embodiment is most preferably finely divided with a mean particle size of around 1 to 20 microns, preferably around 1 to 10 microns, most preferably around 1 to 5 microns. Furthermore, the calcium hydroxide and calcium oxide will be of sufficient purity so as to have abrasive contaminants such as silica and alumina at a level low enough to not significantly impact the anti-wear properties of the resulting grease. Ideally, for best results, the calcium hydroxide and calcium oxide should be either food grade or U.S. Pharmacopeia grade. The total amount of calcium hydroxide and/or calcium oxide will preferably be in the ranges indicated in Tables and Examples herein, particularly Tables 3A and 3B. These amounts are added as separate ingredients in addition to the amount of residual calcium hydroxide or calcium oxide contained in the overbased calcium sulfonate. Most preferably, an excess amount of calcium hydroxide relative to the total amount of complexing acids used is not added prior to conversion. According to yet another embodiment, it is not necessary to add any calcium hydroxide or calcium oxide for reacting with complexing acids and either added calcium carbonate or calcium hydroxyapatite (or both) may be used as the sole added calcium containing base(s) for such reaction or may be used in combination for such reaction.

According to one preferred embodiment of a method for making an overbased calcium magnesium sulfonate grease, an alkali metal hydroxide is dissolved in the water prior to being added to other ingredients. The water used to dissolve the alkali metal hydroxide may be water used as a converting agent or water added post-conversion. It is most preferred to dissolve the alkali metal hydroxide in water prior to adding it to the other ingredients, but it may also be directly added to the other ingredients without first dissolving it in water.

One or more complexing acids, such as long chain carboxylic acids, short chain carboxylic acids, boric acid, and phosphoric acid are also preferably separately added according to some preferred embodiments of the invention when a complex calcium magnesium sulfonate grease is desired. Most preferably, the complexing acids comprise 12-hydroxystearic acid, acetic acid, phosphoric acid, boric acid, or a combination thereof. Preferred range of total separately added complexing acids and preferred amounts for specific types of separately added complexing acids as ingredients by weight percent of the final grease product (although these acids will react with bases and will not be present in the final grease product) are in the Tables and Examples herein.

The amount of short or long chain fatty acids added may be reduced or eliminated when one or more glycerol derivatives are added according to one preferred embodiment of the invention. As used herein, references to "separately added complexing acids" or similar wording refers to complexing acids that are added as separate ingredients or formed in-situ by a reaction of ingredients other than a reaction of an added glycerol derivative and water.

The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture. Additionally, acetic acid and other carboxylic acids may be used as a converting agent or complexing acid or both, depending on when it is added. Similarly, some complexing acids (such as the 12-hydroxystearic acid in the '514 and '467 patents) may also be used as converting agents.

If boric acid is used as a complexing acid according to this embodiment, the boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, borated epoxides, borated peroxides and the like may be used instead of boric acid.

The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

According to another preferred embodiment, a glycerol derivative is preferably added in some embodiments. Preferred glycerol derivatives are mono, di, or tri-acyl glycerides. Most preferably, the glycerol derivative is one or more of hydrogenated castor oil, glyceryl mono-stearate, glyceryl mono-tallowate, and glycerol mono-oleate. Hydrogenated castor oil is essentially the tri acyl glyceride where all three fatty acid ester groups on the glycerol backbone are 12-hydroxystearic acid groups. According to one preferred embodiment, a glycerol derivative and a conventional non-aqueous converting agent are both added prior to conversion. According to another preferred embodiment, magnesium sulfonate and a glycerol derivative are added and no conventional non-aqueous converting agent is added prior to conversion. According to another preferred embodiment, two or more different glycerol derivatives, either with or without any conventional non-aqueous converting agent, are added prior to conversion.

The optionally added glycerol derivative can replace some or all of the normally used complexing acids to react with the one or more calcium containing bases (separately added or that may be included in the overbased calcium sulfonate), to reduce ingredient costs while still maintaining good thickener yield and high dropping point. The glycerol derivative will react with water to form in-situ a complexing acid. Water may be added before, after, or substantially simultaneously with the glycerol derivative.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention. All percentages of ingredients are based on the final weight of the finished grease unless otherwise indicated, even though that amount of the ingredient may not be in the final grease product due to reaction or volatilization.

The calcium sulfonate complex greases according to these preferred embodiments are an NLGI No. 2 grade grease having a dropping point of at least 575 F more preferably of 650 F or greater, but greases with other NLGI grades from No. 000 to No. 3 may also be made according to these embodiments with modifications as will be understood by those of ordinary skill in the art. The use of the preferred methods and ingredients according to the invention appear to improve high temperature shear stability compared to most calcium sulfonate-based greases (that are 100% based on calcium).

According to another preferred embodiment, extremely rheopectic sulfonate-based grease composition may comprise a reduced amounts of base oil to allow for reduced shipping costs. The base oil indicated in Tables 1A-3B above may be reduced for the product to be shipped. Additional base oil may be added as needed at the point of use.

The sulfonate-based grease compositions and methods for making such compositions according to various embodiments the invention are further described and explained in relation to the following examples. Examples 1-6 are the same as various examples in the '387, '388, and '391 patents as noted herein, except that specific information regarding the particular type of overbased calcium sulfonate used is included herein, but was not disclosed in these prior patents. At the time the prior patents were filed, the cause of the extreme rheopectic behavior in two of the examples was not known, but the inventor has determined that the cause relates to the use of certain types of overbased calcium sulfonate comprising benzene rings with multiple alkyl groups and/or sterically hindered benzene rings, preferably without a facilitating delay/magnesium sulfonate delay method, which are believed to favor the reaction between the facilitating acid and the overbased magnesium sulfonate over the reaction between the facilitating acid and the overbased calcium sulfonate. It is noted that all overbased calcium sulfonates do not have the exact same chemical structure, and therefore do not have identical properties. The inventor has found that, in most cases, particular types of overbased calcium sulfonates result in extremely rheopectic sulfonate-based greases that are not produced when other types of overbased calcium sulfonate are used. The inventor has also found that an extremely rheopectic grease is not produced when using this particular type of overbased calcium sulfonate if a simultaneous facilitating acid delay/magnesium sulfonate delay as described in the '387 and '388 patents is used (where the facilitating acid is added and all or a portion of the overbased magnesium sulfonate is the next subsequently added ingredient). As such, according to other preferred embodiments, a method of making an extremely rheopectic sulfonate-based grease using a multiple alkyl group overbased calcium sulfonate addition further comprises (1) adding all the overbased magnesium sulfonate before the facilitating acid or (2) not using a facilitating acid delay where magnesium sulfonate is the next subsequently added ingredient.

Example 1—This Example is the same as Example 27 of U.S. Pat. No. 10,087,387, Example 12 of U.S. Pat. No. 10,087,388; and Example 1 of U.S. Pat. No. 10,087,391. This example uses added calcium carbonate as described in U.S. Pat. No. 9,273,265. This example also used a multiple alkyl group overbased calcium sulfonate addition. The ratio of overbased calcium sulfonate to overbased magnesium sulfonate was about 90/10. The delayed non-aqueous converting agent technique was used. No facilitating acid delay method was used. All the overbased magnesium sulfonate and all the overbased calcium sulfonate were added at the beginning and before adding the facilitating acid.

The grease was made as follows: 310.14 grams of 400 TBN overbased oil-soluble calcium sulfonate were added to an open mixing vessel followed by 345.89 grams of a solvent neutral group 1 paraffinic base oil having a viscosity of about 600 SUS at 100 F. The 400 TBN overbased oil-soluble calcium sulfonate was a good quality calcium sulfonate as described in U.S. Pat. No. 9,458,406 and had one or more of the specific structures related to alkyl groups on the sulfonate benzene ring previously described. In particular, the overbased calcium sulfonate used in this Example is a natural calcium sulfonate and comprises benzene rings that have more than one alkyl group. Mixing without heat began using a planetary mixing paddle. Then 31.60 grams of overbased magnesium sulfonate A was added and allowed to mix in for 15 minutes. This overbased magnesium sulfonate A is the one described in U.S. Pat. No. 10,087,387. Then 31.20 grams of a primarily C12 alkylbenzene sulfonic acid (facilitating acid) were added. After mixing for 20 minutes, 75.12 grams of finely divided calcium carbonate with a mean particle size below 5 microns were added and allowed to mix in for 20 minutes. Then 0.84 grams of glacial acetic acid and 8.18 grams of 12-hydroxystearic acid were added. The mixture was stirred for 10 minutes. Then 40.08 grams water were added, and the mixture was heated with continued mixing to a temperature of 190 F to 200 F. This represents a temperature adjustment delay. The mixture was mixed at this temperature range for 30 minutes. This represents a holding delay. During that time, significant thickening had occurred, with a grease structure having formed. Fourier Transform Infrared (FTIR) spectroscopy indicated that water was being lost due to evaporation. Another 70 ml water were added. FTIR spectroscopy also indicated that conversion had partially occurred even though no hexylene glycol (non-aqueous converting agent) had yet been added. After the 30 minutes holding delay at 190 to 200 F, 15.76 grams of hexylene glycol were added. Shortly after this, FTIR spectroscopy indicating that the conversion of the amorphous calcium carbonate to crystalline calcium carbonate (calcite) had occurred. However, the batch seemed to soften somewhat after the glycol was added. Another 20 ml water were added followed by 2.57 grams of glacial acetic acid and 16.36 grams of 12-hydroxystearic acid. These two complexing acids were allowed to react for 10 minutes. Then 16.60 grams of a 75% solution of phosphoric acid in water were slowly added and allowed to mix in and react.

The grease was then heated to 390 to 400 F. As the mixture was heated, the grease continued to become increasingly thin and fluid. The heating mantle was removed from the mixer and the grease was allowed to cool while continuing to be mixed. The mixture was very thin and had no significant grease texture. When the temperature was below 170 F, a sample was removed from the mixer and given passes through a three-roll mill. The milled grease had an unworked penetration of 189. This result was extremely surprising and indicated that a very unusual and highly rheopectic structure had formed. Three more portions of the same base oil totaling 116.02 grams were added. The grease was then removed from the mixer and given three passes through a three-roll mill to achieve a final smooth homogenous texture. The grease had a worked 60 stroke penetration of 290. The percent overbased oil-soluble calcium sulfonate in the final grease was 31.96%. The dropping point was 617 F. Before milling, this Example 1 grease had an extremely fluid texture. This very unusual property could have multiple applications where a very fluid and pumpable lubricant is needed until it is delivered to the equipment to be lubricated. If either the equipment dispensing the lubricant to the equipment or the equipment itself (or both) can adequately shear the lubricant so as to simulate milling, then a firm grease could be generated. The advantage of such a lubricant is that it would have the pumpability and mobility of a fluid but the texture of a grease in the equipment to be lubricated.

Example 2—This Example is the same as Example 13 of U.S. Pat. No. 10,087,388 and was made similar to the previous Example 1 grease herein. Like the Example 1 grease, the ratio of overbased calcium sulfonate to overbased magnesium sulfonate was about 90/10, and all the overbased magnesium sulfonate was added before conversion, and the delayed non-aqueous converting agent technique was used. The Example 2 grease also used a multiple alkyl group overbased calcium sulfonate addition (the same overbased calcium sulfonate as used in Example 1), but did not result in an extremely rheopectic grease. However, there were several significant changes concerning other aspects of this grease compared to the Example 1 grease. The overbased magnesium sulfonate was added not at the very beginning, but after the primarily C12 alkylbenzene sulfonic acid (facilitating acid) was added and mixed in for an intentional 20 minute delay. This represents a facilitating acid delay method as described in the '388 patent. It also represents a delayed overbased magnesium sulfonate addition method relative to the facilitating acid as described in the '388 patent and the '387 patent. A second portion of powdered calcium carbonate was added after conversion but before the second portion of complexing acids was added. Also, this grease used a higher post-conversion level of 12-hydroxystearic acid. Finally, phosphoric acid was not used as a post-conversion complexing acid. Instead, boric acid was used.

The grease was made as follows: 310.79 grams of 400 TBN overbased oil-soluble calcium sulfonate were added to an open mixing vessel followed by 310.47 grams of a solvent neutral group 1 paraffinic base oil having a viscosity of about 600 SUS at 100 F. The 400 TBN overbased oil-soluble calcium sulfonate was a good quality calcium sulfonate as described in U.S. Pat. No. 9,458,406. Mixing without heat began using a planetary mixing paddle. Then 31.53 grams of a primarily C12 alkylbenzene sulfonic acid were added and allowed to mix in for 20 minutes. Then 31.24 grams of overbased magnesium sulfonate A was added and allowed to mix in. After mixing for 20 minutes, 75.08 grams of finely divided calcium carbonate with a mean particle size below 5 microns were added and allowed to mix in for 20 minutes. Then 0.91 grams of glacial acetic acid and 8.09 grams of 12-hydroxystearic acid were added. The mixture was stirred for 10 minutes. Then 40.51 grams water were added, and the mixture was heated with continued mixing to a temperature of 190 F to 200 F. This represents a temperature adjustment delay. The mixture was mixed at this temperature range for 30 minutes. This represents a holding delay. During that time, significant thickening had occurred, with a grease structure having formed. Fourier Transform Infrared (FTIR) spectroscopy indicated that conversion had partially occurred even though no hexylene glycol (non-aqueous converting agent) had yet been added. After the 30 minutes holding delay at 190 to 200 F, 30 ml water and 15.50 grams of hexylene glycol were added. Shortly after this, FTIR spectroscopy indicating that the conversion of the amorphous calcium carbonate to crystalline calcium carbonate (calcite) had occurred. The batch was stirred for 45 minutes. During that time the batch did not soften but actually became somewhat harder. Another 40 ml water were added followed by another 25.02 grams of the same calcium carbonate. After mixing for 20 minutes, 1.57 grams of glacial acetic acid, 31.94 grams of 12-hydroxystearic acid, and 10 ml water were added. These two complexing acids were allowed to react for 10 minutes. Then 25.0 grams of boric acid in 50 ml of hot water were slowly added and allowed to mix in and react.

The grease was then heated to 340 F. As the mixture was heated, the grease did not significantly soften. The heating mantle was removed from the mixer and the grease was allowed to cool while continuing to be mixed. The batch retained a grease texture as it was cooled. This was an obvious difference in behavior between this grease and the previous Example 1 grease. When the grease was cooled to 200 F, 2.20 grams of an aryl amine antioxidant was added. When the temperature was below 170 F, a sample was removed from the mixer and given passes through a three-roll mill. The milled grease had an unworked penetration of 219. Again, this result was extremely surprising when compared to the behavior of the previous Example 1 grease. Even though the previous Example 1 grease was very fluid at this point in the procedure (no significant grease texture), it exhibited unexpected rheopectic properties in that it milled to a much harder consistency. This indicates that the structure of this Example 2 grease is significantly less rheopectic than the structure of the Example 1 grease. Four more portions of the same base oil totaling 133.53 grams were added. The grease was then removed from the mixer and given three passes through a three-roll mill to achieve a final smooth homogenous texture. The grease had a worked 60 stroke penetration of 283. The percent overbased oil-soluble calcium sulfonate in the final grease was 30.27%. The dropping point was >650 F. Using the customary inverse linear relationship between worked penetration and percent overbased calcium sulfonate concentration, this example grease would have had a percent overbased calcium sulfonate concentration of 29.5% if additional base oil had been added to bring the worked penetration to the same value as the previous Example 1 grease. As can be seen, this grease had an improved thickener yield compared to the previous grease of Example 1, but did not exhibit the extreme rheopectic property of the grease in Example 1. This indicates that the use of a facilitating acid delay/magnesium sulfonate delay negatively impacts the ability to achieve an extremely rheopectic sulfonate-based grease when using a multiple alkyl group overbased calcium sulfonate addition method.

Example 3—This Example is the same as Example 14 of U.S. Pat. No. 10,087,388 and Example 2 of U.S. Pat. No. 10,087,391 and was made similar to the previous Example 1 grease herein. However, there were some differences. First, this grease used the poor quality overbased calcium sulfonate used in most of the examples of U.S. Pat. No. 10,087,387. This overbased calcium sulfonate is a synthetic calcium sulfonate (not a natural sulfonate like that used in Example 1) and comprises monoalkylated benzene rings to a degree that is higher than the overbased calcium sulfonate used in Example 1 (and fewer multiple alkylated benzene rings than the overbased calcium sulfonate used in Example 1). As such, this example did not use a multiple alkyl group overbased calcium sulfonate addition. Second, the overbased magnesium sulfonate was intentionally not added until the initial base oil, overbased calcium sulfonate, and facilitating acid had been added and mixed for 20 minutes without any applied heat. This represents a facilitating acid delay period, like that employed in the previous Example 2 grease. Also like Example 2, this is also considered a delayed overbased magnesium sulfonate addition method with a holding delay and without a temperature adjustment delay. Normally, such short holding delays (20 minutes) are not considered a true holding delay. However, since the facilitating acid will react even at ambient temperature with either an overbased calcium or magnesium sulfonate, such a delay is considered to be a magnesium sulfonate delay period herein. Note again that this same delayed overbased magnesium sulfonate addition technique was done in the previous Example 2 grease. However, in a manner similar to Example 1, this grease used a 16.52 gram addition of a 75% solution of phosphoric acid in water instead of the addition of boric acid in water (as was used in Example 2). The final milled Example 3 grease had a worked 60 stroke penetration of 293. The percent overbased oil-soluble calcium sulfonate in the final grease was 26.78%. However, the dropping point was 520 F.

Like the Example 2 grease, Example 3 exhibited a grease structure prior to milling, it did not exhibit the extreme rheopectic behavior of Example 1, which was extremely fluid prior to milling and did not take on a grease-like structure until after it was milled. These Examples also indicate that the difference between a good quality and poor quality overbased calcium sulfonate does not appear to be a factor in achieving the extremely rheopectic results seen in Example 1. A summary of Examples 1-3 is provided below in Table 4.

TABLE 4

Summary of Examples 1-3

| Example Number | 1 | 2 | 3 |
|---|---|---|---|
| Overbased Calcium Sulfonate Quality | Good | Good (same as Ex. 1) | Poor |
| Overbased Magnesium Sulfonate used | A | A | A |
| Overbased Ca Sulfonate, % (wt) | 31.96 | 30.27 | 26.78 |
| Split Overbased Magnesium Sulfonate Addition Technique Used? | No | No | No |
| % (wt) Mg sulfonate added initially relative to total Mg Sulfonate | 100 | 100 | 100 |
| Ratio of Overbased Ca Sulfonate to Overbased Mg Sulfonate in Pre-Conversion Grease | 90/10 | 90/10 | 90/10 |
| Ratio of Overbased Ca Sulfonate to Overbased Mg Sulfonate in Final Grease | 90/10 | 90/10 | 90/10 |
| Facilitating Acid Delay Method Used? | No | Yes | Yes |
| Reactive component present when DDBSA added | Overbased Ca Sulfonate; overbased Mg Sulfonate | Overbased Ca Sulfonate | Overbased Ca Sulfonate |
| Facilitating Acid Temp. Adj. Delay Used? | No | No | No |
| Facilitating Acid Holding delay Used? | Yes, 20 minutes | Yes, 20 minutes | Yes, 20 minutes |
| Holding Delay temperature, F. | 77 (ambient) | 77 (ambient) | 77 (ambient) |
| First delayed reactive component added after DDBSA | N/A | Overbased Mg Sulfonate | Overbased Mg Sulfonate |
| Non-aqueous converting agent Delayed Addition Method Used? | Yes | Yes | Yes |
| Holding Delay temperature, F. | 190-200 | 190-200 | 190-200 |
| Holding Delay time, minutes | 30 | 30 | 30 |
| Did partial conversion occur before non-aqueous converting agent added? | Yes | Yes | Yes |
| Worked 60 Stroke Penetration | 290 | 283 | 293 |
| Dropping Point, F. | 617 | >650 | 520 |
| Extremely Rheopectic | Yes | No | No |

Example 4—This Example is the same as Example 3 of U.S. Pat. No. 10,087,391 and was made similar to the previous Example 1 grease herein. Like the Example 1 grease, this grease had a ratio of overbased calcium sulfonate to overbased magnesium sulfonate that was about 90/10. No facilitating acid delay method was used. All the overbased magnesium sulfonate was added at the beginning along with the overbased calcium sulfonate, before the facilitating acid was added. This Example 4 grease used a multiple alkyl group overbased calcium sulfonate addition (the same good quality overbased calcium sulfonate as the Example 1 grease) and did result in an extremely rheopectic grease.

The only significant difference between this grease and the Example 1 grease was that this grease did not have any conventional non-aqueous converting agent added. Water was added as required to replace any water lost due to evaporation during the conversion process. Conversion was monitored by FTIR spectra and took 2 hours to complete. The conversion took place due only to water, the overbased magnesium sulfonate, and any effects due to the initial amounts of the pre-conversion complexing acids that were added. As the grease was heated to its top temperature, it significantly softened and became fluid-like in a manner similar to the Example 1 grease. The grease texture was recovered upon milling, just as was observed in the Example 1 grease. This extreme rheopectic property has the same potential utility as mentioned in Example 1. Neither Example 1 nor example 4 used a facilitating acid delay method. Example 1 used a conventional non-aqueous converting delay method, while Example 4 did not use any conventional non-aqueous converting agents, yet both resulted in greases exhibiting extremely rheopectic behavior. Examples 1 and 4 indicate that the use of a natural calcium sulfonate comprising benzene rings having more than one alkyl group is likely contributing to the unexpected behavior.

Example 5—This Example is the same as Example 4 of U.S. Pat. No. 10,087,391 and was made similar to previous Example 4 grease herein, without any conventional non-aqueous converting agents. The only significant difference was that the poor quality overbased calcium sulfonate used in Example 3 was also used in Example 5, rather than the good quality overbased calcium sulfonate comprising benzene rings having more than one alkyl group that was used in Example 4. Conversion was monitored by FTIR spectra and took 7 hours to complete. The resulting grease had a grease-like structure prior to milling and did not have the extreme rheopectic property found in Example 4.

Example 6—This Example is the same as Example 5 of U.S. Pat. No. 10,087,391 and was made similar to previous Example 5 grease herein. The only significant difference was that only about half the amount of overbased magnesium sulfonate was used. This grease used the same poor quality overbased calcium sulfonate as was used in Examples 3 and 5 of this document. Conversion was monitored by FTIR spectra and took 10.5 hours to complete. Like Example 5, the resulting grease had a grease-like structure prior to milling and did not have the extreme rheopectic property found in Example 4. A summary of Examples 4-6 is provided below in Table 5.

TABLE 5

Summary of Examples 4-6.

| Example Number | 4 | 5 | 6 |
|---|---|---|---|
| Quality of Overbased Ca Sulfonate | Good (Same as Ex. 1) | Poor | Poor |
| Overbased Magnesium Sulfonate used | A | A | A |
| Overbased Ca Sulfonate, % (wt) | 32.77 | 37.05 | 34.49 |
| Overbased Mg Sulfonate, % (wt) | 3.47 | 3.72 | 1.68 |
| Ratio of Overbased Ca Sulfonate to Overbased Mg Sulfonate in Final Grease | 90/10 | 90/10 | 95/5 |
| Ratio of Overbased Ca Sulfonate to Overbased Mg Sulfonate in Pre-Conversion Grease | 90/10 | 90/10 | 95/5 |
| Time to convert all amorphous CaCO3 to non-amorphous form, hours | 2 | 7 | 10.5 |
| Unworked Penetration | 280 | 289 | 267 |
| Worked 60 Stroke Penetration | 292 | 295 | 295 |
| Dropping Point, F. | >650 | 558 | 562 |
| Four Ball EP, Weld Load, kg | 500 | 500 | ND |
| Four Ball Wear | 0.37 | 0.37 | 0.38 |
| Roll Stability at 25 C., 2 hrs | | | |
| Initial worked 60 stroke penetration | 269 | 295 | 295 |
| Final worked 60 stroke penetration | 267 | 317 | 303 |
| % Change | −0.7 | 7.5 | 2.7 |
| Dropping Point after test, F | 633 | 520 | 552 |
| Roll Stability at 150 C., 2 hrs | | | |
| Initial worked 60 stroke penetration | 269 | 295 | 295 |
| Final worked 60 stroke penetration | 281 | 301 | 291 |
| % Change | 4.5 | 2.0 | −1.4 |
| Dropping Point after test, F. | >650 | 583 | 574 |
| Extremely Rheopectic | Yes | No | No |

Example 7—A duplicate batch of the previous Example 1 grease was made, using a multiple alkyl group overbased calcium sulfonate addition (the same overbased calcium sulfonate as used in Example 1). The only significant difference between this example and Example 1 was the batch size. This batch was 50% larger than the grease of Example 1. Like Example 1, this example used a delayed non-aqueous converting agent method.

The grease was made as follows: 465.34 grams of 400 TBN overbased oil-soluble calcium sulfonate were added to an open mixing vessel followed by 519.57 grams of a solvent neutral group 1 paraffinic base oil having a viscosity of about 600 SUS at 100 F. The 400 TBN overbased oil-soluble calcium sulfonate was a good quality calcium sulfonate as described in U.S. Pat. No. 9,458,406 and the same overbased calcium sulfonate used in Example 1. Mixing without heat began using a planetary mixing paddle. Then 46.54 grams of overbased magnesium sulfonate A was added and allowed to mix in for 15 minutes. This overbased magnesium sulfonate A is the one described in U.S. Pat. No. 10,087,387. Then 47.72 grams of a primarily C12 alkylbenzene sulfonic acid (facilitating acid) were added. After mixing for 20 minutes, 112.72 grams of finely divided calcium carbonate with a mean particle size below 5 microns were added and allowed to mix in for 20 minutes. Then 1.65 grams of glacial acetic acid and 12.18 grams of 12-hydroxystearic acid were added. The mixture was stirred for 10 minutes. Then 60.0 grams water were added, and the mixture was heated with continued mixing to a temperature of 190 F to 200 F. This represents a converting agent temperature adjustment delay. The mixture was mixed at this temperature range for 30 minutes. This represents a converting agent holding delay. During the converting agent temperature adjustment and holding delays, significant thickening had occurred, with a grease structure having formed. Also, Fourier Transform Infrared (FTIR) spectroscopy indicated that water was being lost due to evaporation. Another three portions of water totaling 104.5 grams water were added during the temperature adjustment and holding delays. FTIR spectroscopy also indicated that conversion had partially occurred even though no hexylene glycol (a conventional non-aqueous converting agent) had yet been added.

After the 30 minute converting agent holding delay at 190 to 200 F, 24.00 grams of hexylene glycol were added. Shortly after this, FTIR spectroscopy indicating that the conversion of the amorphous calcium carbonate to crystalline calcium carbonate (calcite) had occurred. However, the batch seemed to soften somewhat after the glycol was added. During the next one hour, another two portions of water totaling 55.8 grams were added to replace water lost by evaporation.

Then, 1.88 grams of glacial acetic acid and 24.61 grams of 12-hydroxystearic acid were added and allowed to react. These two complexing acids were allowed to react for 10 minutes. Then 24.59 grams of a 75% solution of phosphoric acid in water were slowly added and allowed to mix in and react. The grease was then heated to 390 to 400 F. As the mixture was heated, the grease continued to become increasingly thin and fluid. The heating mantle was removed from the mixer and the grease was allowed to cool while continuing to be mixed. The mixture was very thin and had very little grease texture. When the temperature was below 170 F, another 222.61 grams of the same paraffinic base oil was added and allowed to mix in for one hour and 20 minutes.

A portion of the batch was removed and stored in a steel can. The remaining portion of the batch that was still in the mixer was given a single pass through a laboratory-scale colloid mill with the gap set at 0.005 inches. The milled was stored in a steel can. About 24 hours later, both cans of grease (unmilled and milled/stirred) were evaluated for penetration and dropping point. The final unmilled product was fluid with almost no detectable grease structure. It had an unworked penetration of 499. A worked penetration was not determined. A dropping point was also not determined since the dropping point test is meaningless for such a fluid product. The milled grease had an unworked penetration of 283 and a worked 60 stroke penetration of 315. The dropping point was >650 F. The percent overbased calcium sulfonate in both unmilled and milled products was 30.95%. As can be seen, this example grease gave very similar results to the Example 1 grease. Both demonstrated extreme rheopectic behavior.

The extreme rheopectic behavior of the Example 7 grease can also be seen by using oscillatory rheometry. FIG. 1 provides an amplitude sweep at 25 C for the unmilled and milled Example 7 grease. The storage modulus (G') curves represent the structural effect of the dispersed phase (thickener system) of the grease during the test. The loss modulus (G") curves represent the structural effect of the non-dispersed, continuous phase (base oil system) of the grease during the test. The crossover points for the G' and G" curves is a measure of the mechanical stability of the grease structure. As can be seen, the wide difference between the corresponding G' and G" curves for the two materials provides a measure of how much the unmilled product thickens when milled. In reviewing such rheometry graphs, it should be noted that both axes use logarithmic scales.

Example 8—Another calcium sulfonate complex grease was made similar to the previous Example 7 grease. The only significant difference was that this grease used a different 400 TBN overbased calcium sulfonate, which is believed to comprise fewer benzene rings having more than one alkyl group compared to the overbased calcium sulfonate used in the previous Example 7 grease. This overbased calcium sulfonate was also a good quality calcium sulfonate as described in U.S. Pat. No. 9,458,406. Unlike Example 7, this batch did not soften after addition of the hexylene glycol and did not lose its distinct grease structure upon heating to top temperature and upon cooling. The final unmilled grease in Example 8 had an unworked penetration of 325 and a worked 60 stroke penetration of 333. The dropping point was >650 F. The milled grease had an unworked penetration of 257 and a worked 60 stroke penetration of 291. The dropping point was 641 F. The percent overbased calcium sulfonate in both unmilled and milled greases was 30.77%. The extreme rheopectic behavior of Example 7 was not found in Example 8. The only significant difference between these two examples was the specific overbased calcium sulfonate used and the degree and type of alkylization of the benzene rings of those overbased calcium sulfonates.

Figure 2:
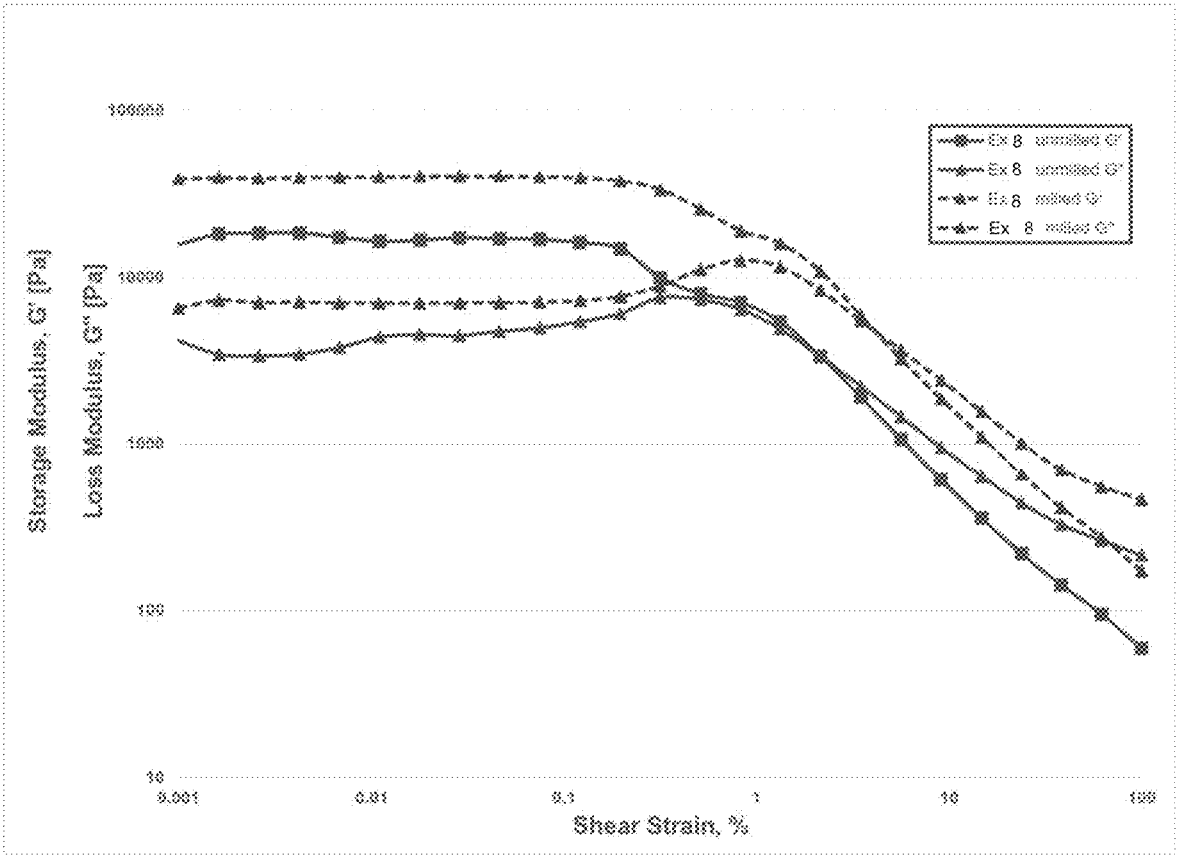
FIG. 2 is a graph showing results of an oscillatory rheometry amplitude sweep at 25 C of the Example 8 unmilled and milled greases.

FIG. 2 provides an amplitude sweep at 25 C for the unmilled and milled Example 8 greases. As can be seen, the difference between the corresponding G' and G" curves for the two materials is not nearly as wide as in FIG. 1. In fact, the G' and G" curves for the unmilled Example 8 grease overlaps the G' and G" curves for the corresponding milled grease. This is very different compared to FIG. 1 (Example 7) where there was a significant gap between the G' and G" curves for the two materials. FIG. 2 is typical for a calcium sulfonate complex or calcium-magnesium sulfonate complex grease where extreme rheopectic behavior is not observed.

Example 9—Another calcium sulfonate complex grease was made similar to the previous Example 7 and 8 greases. The only significant difference was that this grease used a 400 TBN overbased calcium sulfonate that was different from either of the ones used in the previous Example 7 and 8 greases. This overbased calcium sulfonate was the same poor quality, synthetic overbased calcium sulfonate with a relatively higher level of monoalkylated benzene rings used in the previous grease Examples 3, 5 and 6.

Like the Example 3, 5, and 6 greases, this batch did not soften after addition of the hexylene glycol and did not lose its distinct grease structure upon heating to top temperature and upon cooling. The final unmilled grease had an unworked penetration of 307 and a worked 60 stroke penetration of 315. The dropping point was 600 F. The milled grease had an unworked penetration of 259 and a worked 60 stroke penetration of 271. The dropping point was 621 F. The percent overbased calcium sulfonate in both unmilled and milled greases was 28.30%.

Figure 3:
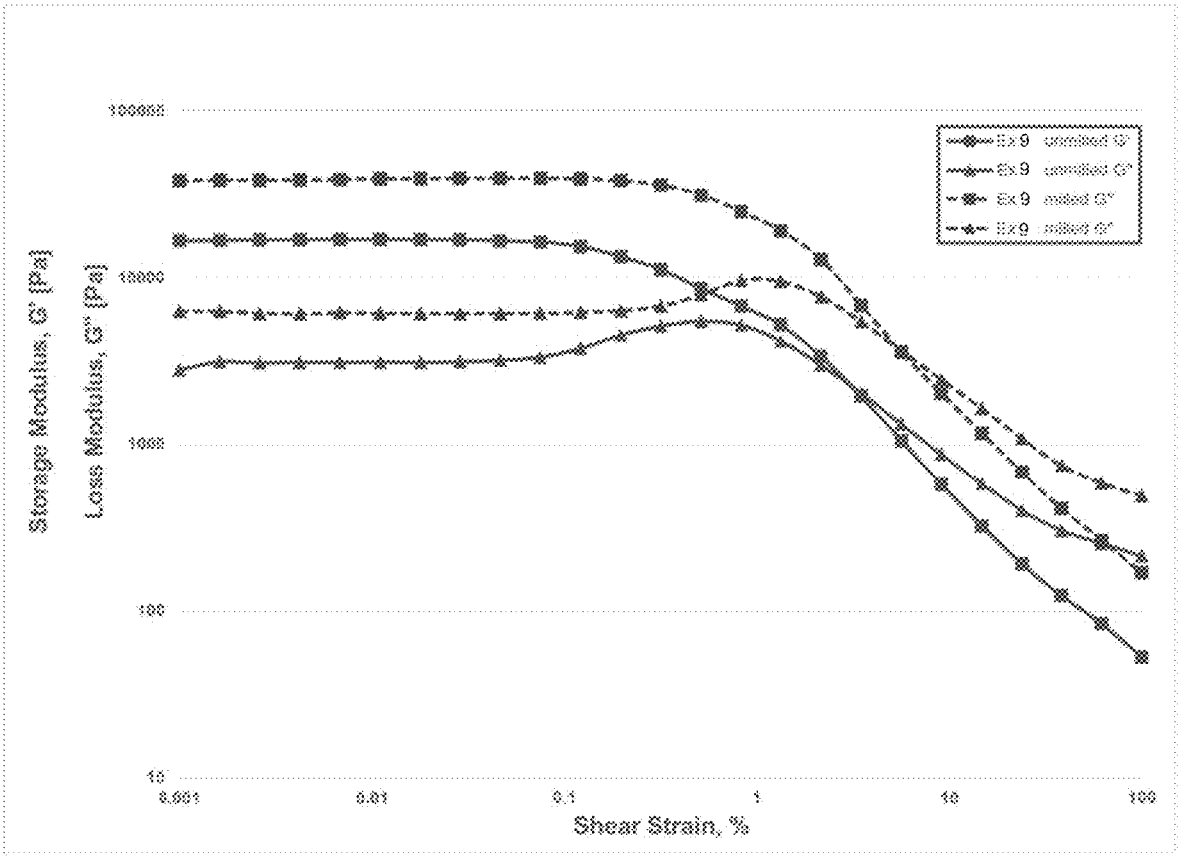
FIG. 3 is a graph showing results of an oscillatory rheometry amplitude sweep at 25 C of the Example 9 unmilled and milled greases.

FIG. 3 provides an amplitude sweep at 25 C for the unmilled and milled Example 9 greases. As with the previous Example 8 grease, the gap between the corresponding G' and G" curves for the unmilled and milled Example 9 greases are significantly less than what was observed the Example 7 greases (FIG. 1), indicating that Example 9 is another example of typical sulfonate-based grease behavior, rather than the extreme rheopectic behavior seen in other examples.

Examples 7-9 used the same converting agent delay method and same ingredients, except for the specific overbased calcium sulfonate used. Only Example 7 exhibited extreme rheopectic behavior.

Example 10—Another calcium sulfonate complex grease was made similar to the previous Examples 7-9 greases. The only significant difference was that this grease used a yet different good quality 400 TBN overbased calcium sulfonate, different from both Examples 7 and 8. Like Example 8, and unlike Example 7, this batch did not soften after addition of the hexylene glycol and did not lose its distinct grease structure upon heating to top temperature and upon cooling. The final unmilled grease had an unworked penetration of 355. The worked 60 stroke penetration was not determined. The milled grease had an unworked penetration of 351 and a worked 60 stroke penetration of 349. The dropping point was >650 F. The percent overbased calcium sulfonate in both unmilled and milled greases was 31.0%.

Figure 4:
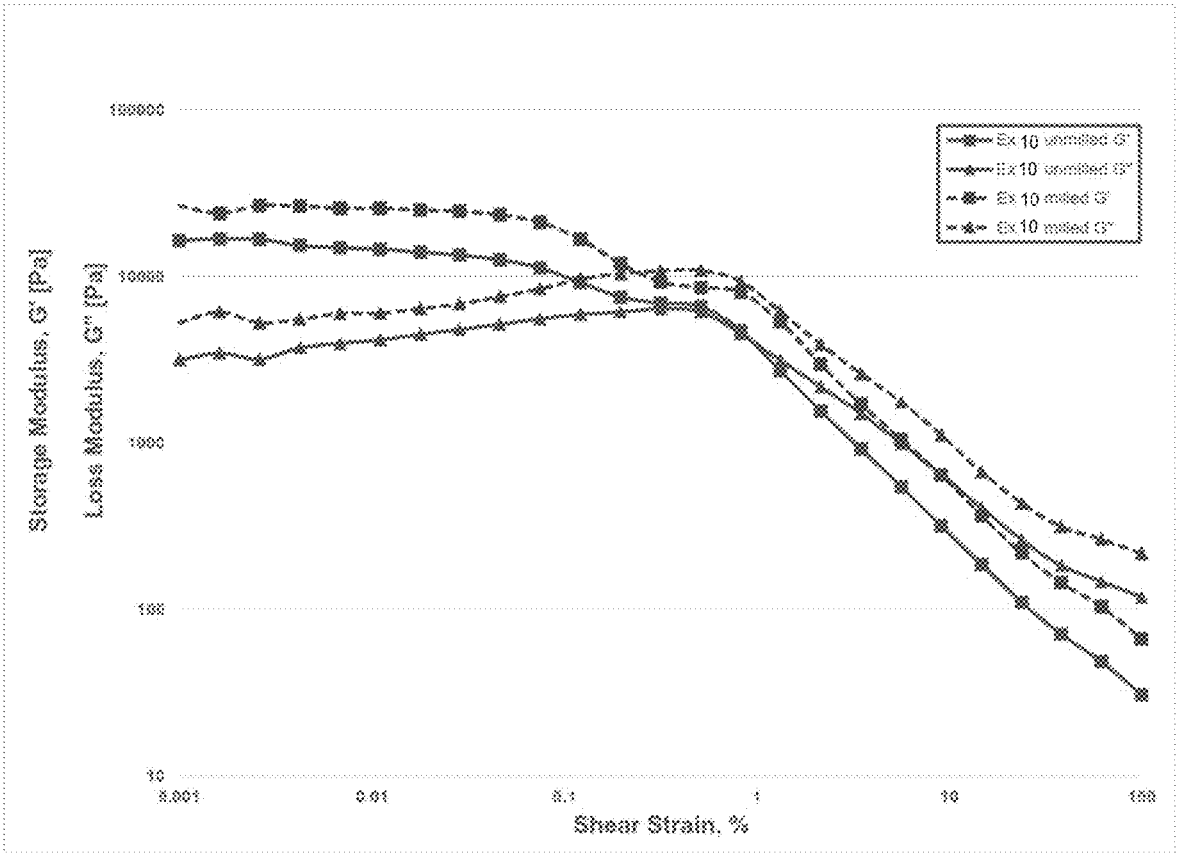
FIG. 4 is a graph showing results of an oscillatory rheometry amplitude sweep at 25 C of the Example 10 unmilled and milled greases.

FIG. 4 provides an amplitude sweep at 25 C for the unmilled and milled Example 10 greases. As with the previous Example 8 and 9 greases, the gap between the corresponding G' and G" curves for the unmilled and milled greases is significantly less than what was observed in FIG. 1 for Example 7.

It is noteworthy that the greases of Examples 7-10 are essentially identical in many respects. They had essentially the same final composition. All four greases used the same ratio of overbased calcium sulfonate to overbased magnesium sulfonate (10/1). All four greases had the facilitating acid (DDBSA) added after all of both the overbased calcium and overbased magnesium sulfonates had been added. All four greases used the same overbased magnesium sulfonate, base oil, and other components. All the other components were added in the same order at about the same temperature. The only significant difference between these four greases was the specific overbased calcium sulfonate that was used. Only Example 7, using a natural sulfonate comprising benzene rings having multiple alkyl groups at a relatively higher level, exhibited extreme rheopectic behavior. The Example 8-10 greases did not.

It is also important to note that whether or not the overbased calcium sulfonate is good or poor quality is not the reason why only the Example 7 grease was extremely rheopectic whereas the other three were not. Examples 8 and 10 also used good quality overbased calcium sulfonates, but they did not demonstrate the extreme rheopectic behavior of Example 7. Neither did the grease of Example 9 which used a poor quality overbased calcium sulfonate.

As previously noted, a primary cause of the extreme rheopectic behavior is believed to be the reaction product between the facilitating acid and magnesium sulfonate. When DDBS (which is a strong organic acid) is used as a preferred facilitating acid, that reaction product is magnesium dodecylbenzene sulfonate. When added to other ingredients to make a sulfonate-based grease, the DDBSA will very rapidly react with the strongest base it encounters. Such acid-base reactions are very rapid and irreversible under the conditions used to make these greases. When only overbased calcium sulfonate is present at the time the DDBSA is added (as with typical overbased calcium sulfonate greases or when using some embodiments of a magnesium sulfonate delayed addition according to the '387 patent), the DDBSA will quickly react with some of the basic components present in the overbased calcium sulfonate. Within overbased calcium sulfonate, the most basic component present is the small amount of residual calcium hydroxide, as measured by the Strong Base Number. When both overbased calcium and overbased magnesium sulfonate are present at the time the DDBSA is added, the DDBSA can potentially react with basic components of either sulfonate. However, in Examples 1, 4, and 7, the DDBSA appears to react more with the overbased magnesium sulfonate than the overbased calcium sulfonate (even though both were present when the facilitating acid was added), resulting in the extreme rheopectic behavior. The inventor has discovered that this is due to the specific type of overbased calcium sulfonate used in these examples.

The distinguishing features of the overbased calcium sulfonate of Examples 1, 4, and 7 compared to the other overbased calcium sulfonates used are that it (1) comprises benzene rings having more than one alkyl group and/or (2) is a natural sulfonate, not a synthetic sulfonate. Also, the greater amount of those multiple alkyl groups are believed to have a higher level of branching. Without being bound by theory, it is believed that this results in greater steric hindrance, which slows the reaction between the calcium sulfonate used in Examples 1, 4, and 7 and the facilitating acid, allowing the facilitating acid to react more with the overbased magnesium sulfonate. This theory is further supported by the contrary behavior in Example 2, which used the same overbased calcium sulfonate as Examples 1, 4, and 7 but did not result in an extremely rheopectic grease. In Example 2, the overbased magnesium sulfonate was not added until after the overbased calcium sulfonate and facilitating acid had been added (a facilitating acid/magnesium sulfonate delay). By delaying the addition of the overbased magnesium sulfonate, the facilitating acid was forced to react with only the overbased calcium sulfonate, leaving no facilitating acid to react with the overbased magnesium sulfonate to form the reaction product believed to contribute to the extremely rheopectic behavior. Although a facilitating acid/magnesium sulfonate delay period has certain benefits, including improvements in thickener yield and dropping point, it is detrimental to forming an extremely rheopectic grease, at least when all of the overbased magnesium sulfonate is added after the overbased calcium sulfonate and facilitating acid.

As having a sulfonate-based grease with such extreme rheopectic behavior would be beneficial without having to use a particular type of overbased calcium sulfonate like that used in these Examples (e.g. typical overbased calcium sulfonates comprising a relatively higher amount of monoalkylated benzene rings, which would be less sterically hindered), several other example greases were prepared in an effort to increase the reaction between the facilitating acid and the overbased magnesium sulfonate.

Example 11—Another calcium-magnesium sulfonate grease was made similar to the previous Example 8 grease (which did not have extreme rheopectic behavior). The only significant difference is that only 10% of the total amount of overbased calcium sulfonate is initially added. The remaining 90% of the overbased calcium sulfonate is added after the facilitating acid is added. This is a split-addition of the overbased calcium sulfonate, with both additions added before conversion. Additionally, an intentional delay of 20 minutes between the addition of the facilitating acid and the second portion of the overbased calcium sulfonate was used, which is a calcium sulfonate holding delay period. Additionally, the ratio of overbased calcium sulfonate to overbased magnesium sulfonate present when the facilitating acid (DDBSA) is added is only 1/1 instead of 10/1 used in example 8.

The grease was made as follows: 48.68 grams of 400 TBN overbased oil-soluble calcium sulfonate were added to an open mixing vessel followed by 520.47 grams of a solvent neutral group 1 paraffinic base oil having a viscosity of about 600 SUS at 100 F. The 400 TBN overbased oil-soluble calcium sulfonate was a good quality calcium sulfonate as described in U.S. Pat. No. 9,458,406. Additionally, it was the same overbased calcium sulfonate used in the previous Example 8 grease (which did not result in extreme rheopectic behavior in that example). Mixing without heat began using a planetary mixing paddle. Then 46.79 grams of overbased magnesium sulfonate A was added and allowed to mix in for 15 minutes. This overbased magnesium sulfonate A is the one described in U.S. Pat. No. 10,087,387. Then 46.25 grams of a primarily C12 alkylbenzene sulfonic acid (facilitating acid) were added. After mixing for 20 minutes, another 416.53 grams of the same overbased calcium sulfonate was added and allowed to mix in for 20 minutes. This is a calcium sulfonate holding delay and a split addition of calcium sulfonate with both portions of the overbased calcium sulfonate added before conversion began.

Then 112.62 grams of finely divided calcium carbonate with a mean particle size below 5 microns were added and allowed to mix in for 20 minutes. Then 1.29 grams of glacial acetic acid and 12.13 grams of 12-hydroxystearic acid were added. The mixture was stirred for 10 minutes. Then 61.2 grams water were added, and the mixture was heated with continued mixing to a temperature of 190 F to 200 F. This represents a converting agent temperature adjustment delay. The mixture was mixed at this temperature range for 30 minutes. This represents a converting agent holding delay. During the converting agent temperature adjustment and holding delays, no significant thickening had occurred; a grease structure had not yet formed. Also, Fourier Transform Infrared (FTIR) spectroscopy indicated that water was being lost due to evaporation. Another two portions of water totaling 62.4 grams water were added during the temperature adjustment and holding delays. After the 30 minute converting agent holding delay at 190 to 200 F, 24.15 grams of hexylene glycol were added. Within two minutes a heavy grease structure had formed. Another 147.92 grams of the same paraffinic base oil was added. During the next 45 minutes two more portions of water totaling 103.7 grams were added to replace water lost by evaporation. Shortly after this, FTIR spectroscopy indicated that the conversion of the amorphous calcium carbonate to crystalline calcium carbonate (calcite) had occurred.

Then, 2.46 grams of glacial acetic acid and 24.63 grams of 12-hydroxystearic acid were added and allowed to react. These two complexing acids were allowed to react for 10 minutes. Then 25.29 grams of a 75% solution of phosphoric acid in water were slowly added and allowed to mix in and react. The grease was then heated to 390 to 400 F. As the mixture was heated, the grease became increasingly thin and fluid, unlike what was observed in Example 8. The heating mantle was removed from the mixer and the grease was allowed to cool while continuing to be mixed. The mixture was very thin and had very little grease texture. When the temperature was below 250 F, another 74.34 grams of the same paraffinic base oil was added and allowed to mix in until the batch temperature was below 170 F.

A portion of the batch was removed and stored in a steel can. The remaining portion of the batch that was still in the mixer was given a single pass through a laboratory-scale colloid mill with the gap set at 0.005 inches. The milled was stored in a steel can. About 24 hours later, both cans of grease (unmilled and milled/stirred) were evaluated for penetration and dropping point. The final unmilled product was fluid with almost no detectable grease structure. It had an unworked penetration of 555. A worked penetration was not determined. A dropping point was also not determined since the dropping point test is meaningless for such a fluid product. The milled grease had an unworked penetration of 259 and a worked 60 stroke penetration of 295. The dropping point was 620 F. The percent overbased calcium sulfonate in both unmilled and milled products was 30.94%.

As can be seen, this Example 11 grease gave very similar results to the highly rheopectic Example 7 grease. In fact, the degree of rheopectic behavior of this Example 11 grease was somewhat greater than the Example 7 grease. Yet, this Example 11 grease used the same overbased calcium sulfonate that did not result in extreme rheopectic behavior in Example 8. The only difference between Example 8 and Example 11 was the timing of adding the overbased calcium sulfonate—as Example 11 used a split addition of the overbased calcium sulfonate and a calcium sulfonate holding delay, but all the overbased calcium sulfonate was added at the same time and before the facilitating acid in Example 8. This demonstrates that the timing of adding overbased calcium sulfonate relative to the overbased magnesium sulfonate and facilitating acid results in the extreme rheopectic behavior regardless of the type or specific overbased calcium sulfonate used.

Figure 5:
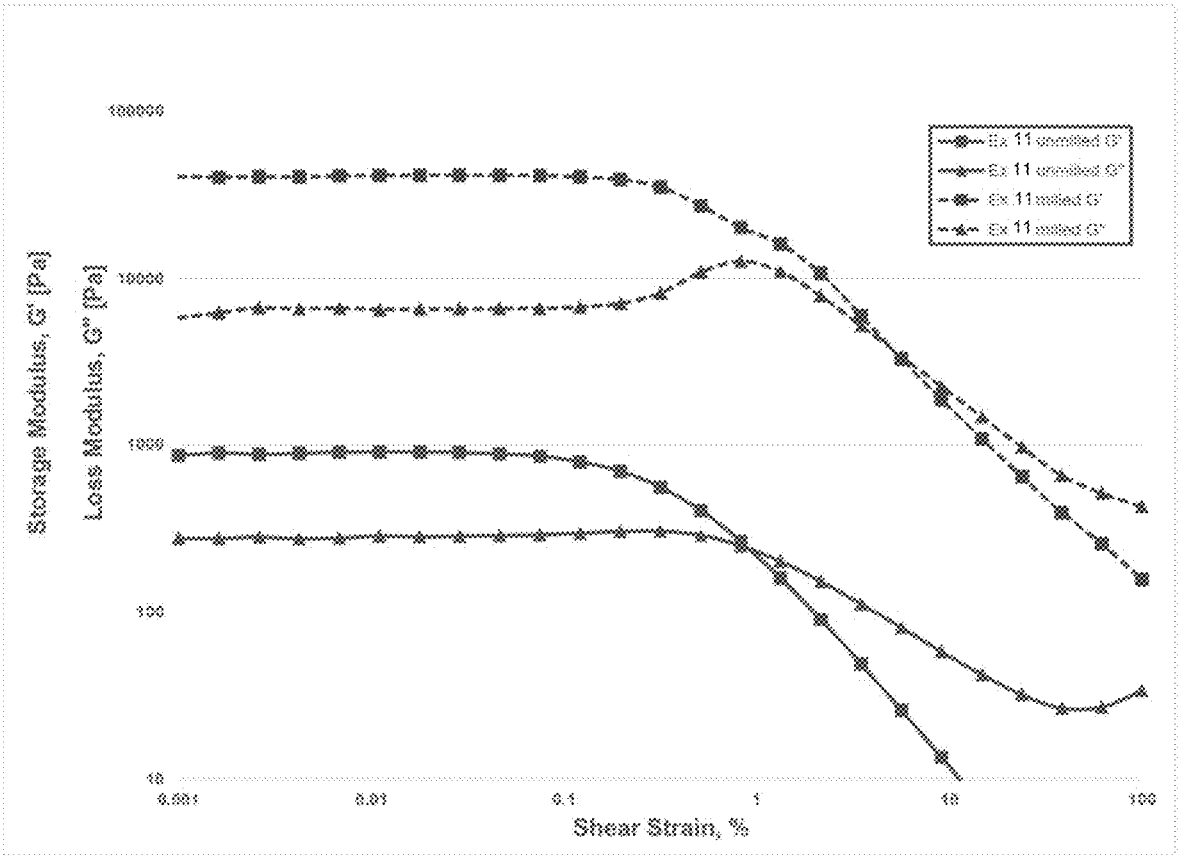
FIG. 5 is a graph showing results of an oscillatory rheometry amplitude sweep at 25 C of the Example 11 unmilled milled greases.

This observation is confirmed by oscillatory rheometry. FIG. 5 provides the results of an amplitude sweep at 25 C for the unmilled and milled Example 11 material. By comparing the G' and G" curves of FIG. 5 with those of FIG. 1, it is apparent that the gap between the unmilled and milled material is greater for Example 11 than for Example 7. Comparison of FIGS. 1 and 5 also confirm another observation. The G' curves of the milled Example 7 and 11 greases have nearly the same modulus values before the yield point (the relative shear strain value where the G' value begins to decrease). However, the G' and G" values for unmilled Example 11 grease are much lower than the G' and G" values for the unmilled Example 7 grease. This means that the increased rheopectic behavior of Example 11 relative to Example 7 is not primarily due to it being a harder grease (or having more structure) when milled compared to Example 7. Instead, the increased rheopectic behavior of Example 11 relative to Example 7 is due to it being a much more fluid in its unmilled state (having less structure) compared to Example 7. Thus, it appears that the magnesium dodecylbenzene sulfonate formed pre-conversion using the calcium sulfonate addition methods in Example 11 alters the final product structure of a calcium-magnesium sulfonate complex grease so as to make the unmilled product more fluid (less structure) while preserving the ability to form the same highly structured thickener dispersion with mechanical milling.

Example 12—Another calcium-magnesium sulfonate grease was made similar to the previous Example 11 grease, using the same overbased calcium sulfonate used in Examples 8 and 11. The only significant difference was that this grease delayed the addition of all the overbased calcium sulfonate until after the facilitating acid (DDBSA) had been added to the initial mixture of base oil and overbased magnesium sulfonate. By using this process technique, the DDBSA was forced to react with only the magnesium sulfonate.

During the heating to conversion temperature and during the conversion process, this grease behaved similar to the previous Example 11 grease. As it was heated to the top temperature (390 F to 400 F), it thinned out significantly. It remained thin during cooling. However, the final unmilled grease did not visually appear as thin as the previous Example 11 grease.

The final unmilled product had almost no detectible grease structure. It had an unworked penetration of 469. Comparing this value with the unworked penetration of the unmilled previous Example 11 grease confirms the visual assessment that Example 12 was more fluid than Example 11 in its unmilled state. A worked penetration for the unmilled Example 12 product was not determined. A dropping point was also not determined since the dropping point test is meaningless for such a fluid product. The milled grease had an unworked penetration of 281 and a worked 60 stroke penetration of 319. The dropping point was >650 F. The percent overbased calcium sulfonate in both unmilled and milled products was 29.65%.

Figure 6:
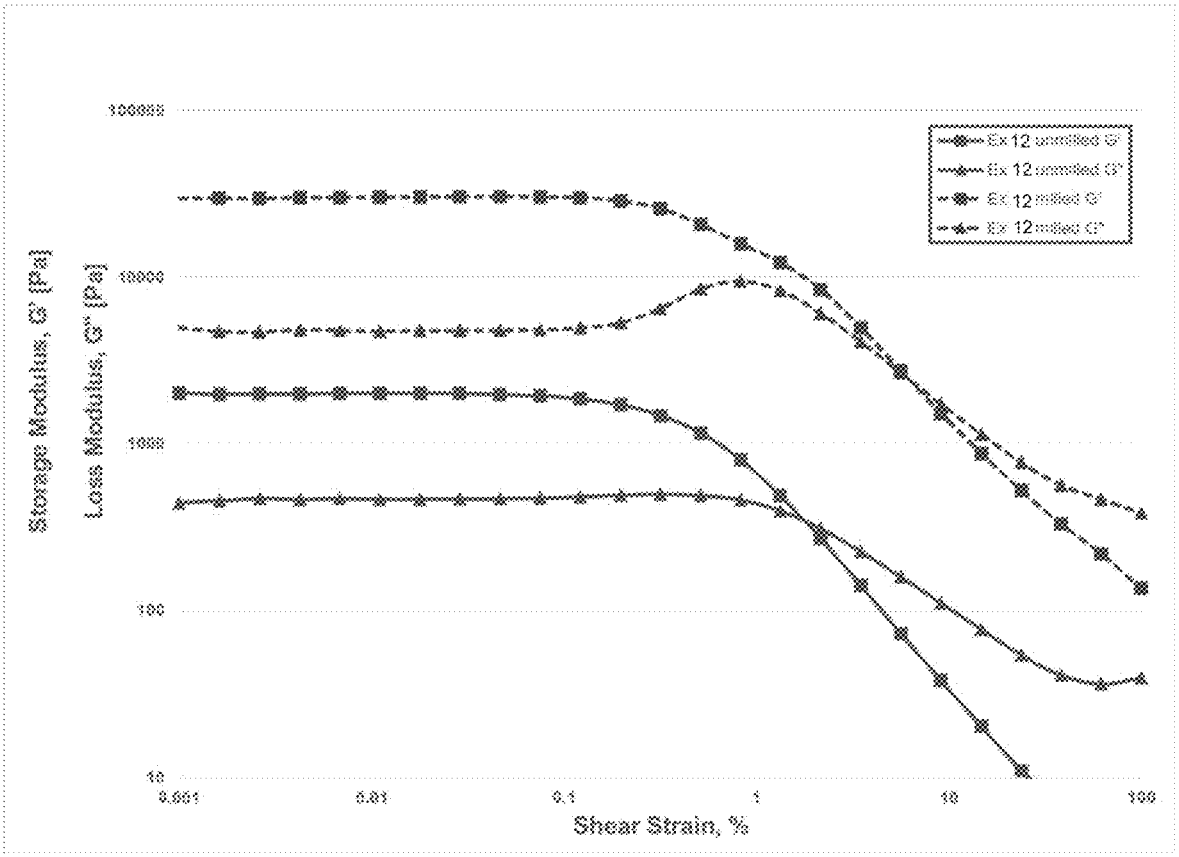
FIG. 6 is a graph showing results of an oscillatory rheometry amplitude sweep at 25 C of the Example 12 unmilled and milled.

As can be seen, this grease was much more rheopectic than the previous Example 8 grease that used the same overbased calcium sulfonate. However, it was not as rheopectic as the previous Example 11 grease which also used the same overbased calcium sulfonate. As such, it appears that at least some overbased calcium sulfonate may be required to be present when the facilitating acid is added to achieve maximum rheopectic behavior. This is unexpected since it is the reaction of the DDBSA with the overbased magnesium sulfonate that is believed to be a primary cause of the extreme rheopectic behavior, but the presence of the overbased calcium sulfonate (at least one that is not as sterically hindered as used in these examples) should compete with the overbased magnesium sulfonate in reacting with the facilitating acid, resulting in a lessening of the rheopectic behavior, not the even greater rheopectic behavior observed. The relative rheopectic behavior of this Example 12 grease can be further observed in FIG. 6. The distinct gap between the G' and G" curves of the unmilled and milled material demonstrates the rheopectic property. But that gap is smaller than the Example 11 gap as seen in FIG. 5.

Example 13—The Example 11 grease demonstrated that it is possible to make an extremely rheopectic calcium-magnesium sulfonate complex grease with any overbased calcium sulfonate by adjusting the ratio of overbased calcium sulfonate to overbased magnesium sulfonate before adding the facilitating acid (DDBSA). However, when using the overbased calcium sulfonate of Example 7, no such adjustment was required. With the Example 7 grease, the ratio of overbased calcium sulfonate to overbased magnesium sulfonate was 10/1 when the DDBSA was added. This ratio provided a very rheopectic grease. Another calcium-magnesium sulfonate grease was made in Example 13 to determine if the initial ratio of overbased calcium sulfonate to overbased magnesium sulfonate in a grease that is the similar Example 7 would result in a grease that is even more rheopectic.

This grease was similar to the previous Example 11 grease, with a split addition of overbased calcium sulfonate and a calcium sulfonate delay period. There was only one significant difference: this grease used the overbased calcium sulfonate of the previous Example 7 grease. However, like the Example 11 grease, enough of that overbased calcium sulfonate was initially held out so that the initial ratio of overbased calcium sulfonate to overbased magnesium sulfonate was 1/1, rather than the 10/1 ratio in Example 7. After the DDBSA was added and allowed to react, the remaining required amount of overbased calcium sulfonate was added.

This Example 13 grease behaved like the previous Example 11 grease during all parts of its manufacturing. The only difference was that this Example 13 grease became even more fluid in its final unmilled state compared to the Example 11 grease. The unmilled product was too fluid to evaluate by penetration. In fact, the unmilled product in Example 13 was completely Newtonian, but the milled product had a very substantial grease structure. The unworked penetration was 257. The worked penetration was 305. The dropping point was >650 F. The percent overbased calcium sulfonate in both unmilled and milled products was 30.89%. Although an extremely rheopectic sulfonate-based grease can be made using the split addition of overbased calcium sulfonate and delayed calcium sulfonate methods regardless of what overbased calcium sulfonate is used, even more extreme results, including a composition that is Newtonian prior to milling, may be achieved when the overbased calcium sulfonate is one that comprises a relatively higher amount of benzene rings having multiple alkyl groups.

Figure 7:
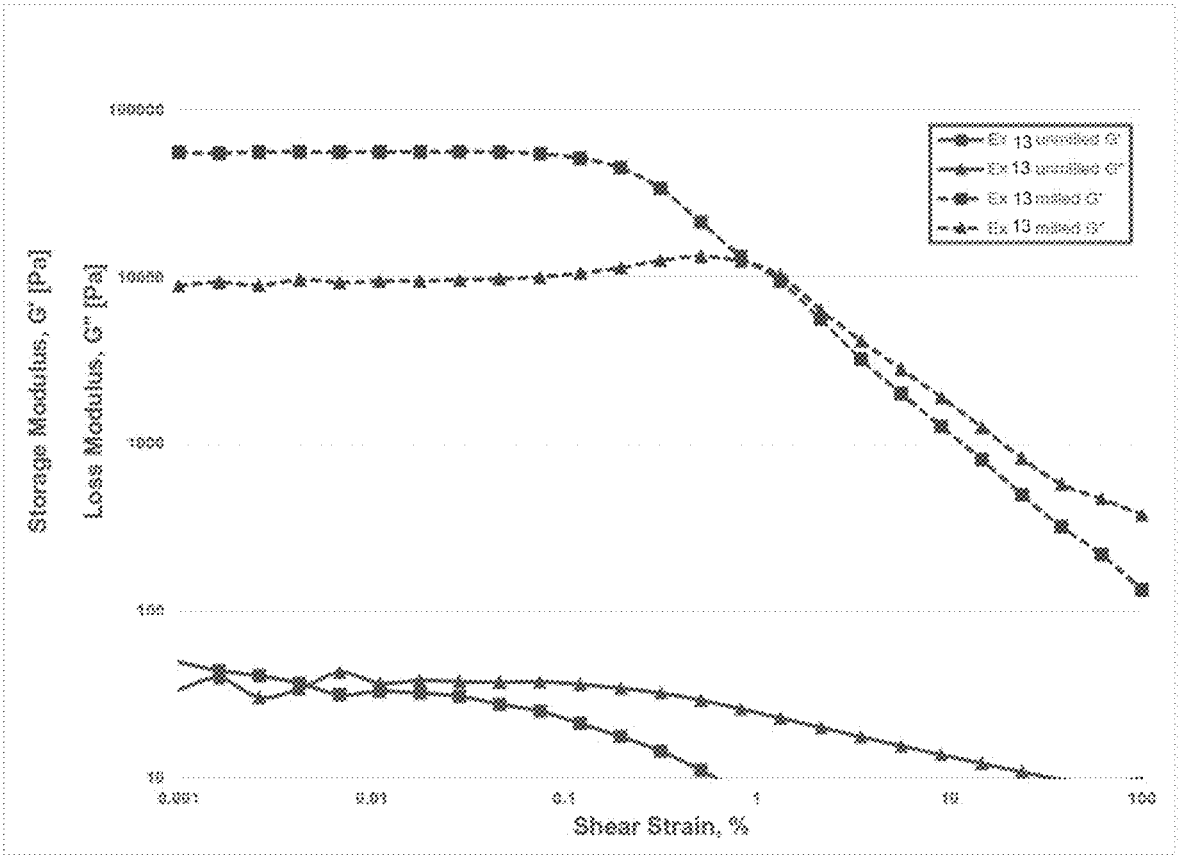
FIG. 7 is a graph showing results of an oscillatory rheometry amplitude sweep at 25 C of the Example 13 unmilled and milled greases.

Oscillatory rheometry demonstrates just how rheopectic this Example 13 grease is. FIG. 7 provides the amplitude sweep results at 25 C for Example 15. As can be seen, the gap between the G' and G" curves for the unmilled and milled material is larger than any previous Example grease. Also, it should be noted that the G' and G" curves of the unmilled material are initially converged. This is an indication of the Newtonian nature and complete lack of any significant grease structure for this unmilled material.

Comparing the milled grease curves of FIGS. 1 (Ex. 7), 5 (Ex. 11), and 7 (Ex. 13), it is noted that the modulus values are nearly identical for all three milled greases. This means that regardless of the extent of rheopectic behavior in the unmilled material of Examples 7, 11, and 13, once milled, the greases have very similar consistency. It is the degree of fluidity (loss of structure) imparted to the unmilled product that varies within the set of these three greases. A summary of test data for Examples 7-13 is provided in Table 6.

TABLE 6

Summary of Examples 7-13

| Example Number | 7 | 8 | 9 | 10 | 11 | 12 | 13 |
|---|---|---|---|---|---|---|---|
| Quality of Overbased Ca Sulfonate | Good (same as Ex. 1) | Good (but diff. from Ex. 1) | Poor (same as Ex. 3) | Good (Good, but diff. from Ex. 1 and 8) | Good (Same as Ex 8) | Good (Same as Ex 8) | Good (Same as Ex 1) |
| Overbased Magnesium Sulfonate used | A | A | A | A | A | A | A |
| Overbased Ca Sulfonate, % (wt) | 30.95 | 30.77 | 28.3 | 31.0 | 30.94 | 29.65 | 30.89 |
| Overbased Mg Sulfonate, % (wt) | 3.1 | 3.08 | 2.83 | 3.12 | 3.11 | 2.99 | 3.1 |
| Unmilled | | | | | | | |
| Unworked Penetration | 499 | 325 | 307 | 355 | 555 | 469 | ND |
| Worked 60 Stroke Penetration | ND | 333 | 315 | ND | ND | ND | ND |
| Dropping Point, F. | ND | >650 | 600 | ND | ND | ND | ND |
| (Unmilled) Roll Stability at 25 C., 10 minutes | | | | | | | |
| Final unworked penetration | 335 | ND | ND | ND | ND | ND | 297 |
| Final worked penetration | 329 | 321 | ND | ND | ND | ND | 299 |
| Milled | | | | | | | |
| Unworked Penetration | 283 | 257 | 259 | 351 | 259 | 281 | 257 |
| Worked 60 Stroke Penetration | 315 | 291 | 271 | 349 | 295 | 319 | 305 |
| Dropping Point, F. | >650 | 641 | 621 | >650 | 620 | >650 | >650 |
| Extremely Rheopectic | Yes | No | No | No | Yes (more than Ex. 7 | Yes (slightly less than Ex. 11) | Yes (most extreme - Newtonian Fluid) |

TABLE 7

Pre-Yield Point Average Modulus Values of Examples 7-13

| Grease | Ave G' (first 6 points) | Ave G" (first 6 points) | Ave G* (first 6 points) | Delta G' | Delta G" | Delta G* |
|---|---|---|---|---|---|---|
| Ex 7 unmilled | 3513 | 959 | 3641 | 43421 | 9690 | 44485 |
| Ex 7 milled | 46934 | 10649 | 48126 | | | |
| Ex 8 unmilled | 17284 | 3753 | 17686 | 22052 | 3198 | 22258 |
| Ex 8 milled | 39335 | 6951 | 39945 | | | |
| Ex 9 unmilled | 16714 | 3044 | 16989 | 21846 | 3081 | 22055 |
| Ex 9 milled | 38560 | 6125 | 39043 | | | |
| Ex 10 unmilled | 15731 | 3610 | 16140 | 9949 | 2084 | 10164 |
| Ex 10 milled | 25680 | 5695 | 26304 | | | |
| Ex 11 unmilled | 892 | 279 | 935 | 39665 | 6118 | 40124 |
| Ex 11 milled | 40557 | 6397 | 41059 | | | |
| Ex 12 unmilled | 2001 | 459 | 2053 | 27708 | 4324 | 28038 |
| Ex 12 milled | 29709 | 4783 | 30091 | | | |
| Ex 13 unmilled | 39 | 36 | 53 | 55556 | 9188 | 56302 |
| Ex 13 milled | 55596 | 9224 | 56356 | | | |

A closer examination of the amplitude sweep data of Examples 7-13 (as graphically presented in FIGS. 1-7) is provided in Table 7 and provides further insight into the rheopectic behavior of some of these examples. The complex modulus, G*, is defined by the following equation: $G^*=((G'')^2+(G'')^2)^{0.5}$ G* is a measure of the overall structure of a material due to both the solid (elastic) portion and the liquid (viscous) portion. For a grease or grease-like material, this translates to the thickener portion and the base oil portion, respectively. Delta G', Delta G", and Delta G* for a given grease are defined respectively as follows:

$$\text{Delta } G'=G'(\text{milled})-G'(\text{unmilled})$$

$$\text{Delta } G''=G''(\text{milled})-G''(\text{unmilled})$$

$$\text{Delta } G^*=G^*(\text{milled})-G^*(\text{unmilled})$$

Thus, these three delta functions represent respectively the amount of structure that is imparted by the action of mechanical milling to the thickener, to the base oil fraction, or to the total grease. Several things can be noted from the Table 7 data: (1) The greases with the greatest observed rheopectic behavior (Examples 7, 11, and 13) also had the largest Delta G', Delta G", and Delta G* values. (2) Upon milling, rheopectic behavior manifested itself by large increases in structure due to both the thickener (Delta G') and the base oil fraction (Delta G"). This resulted in increases in overall grease structure (Delta G*). (3) Unmilled greases that exhibited extreme rheopectic behavior upon milling had much lower G' and G" values compared to greases that did not exhibit such extreme rheopectic behavior. This confirms that extreme rheopectic behavior is largely due to very low structure in the unmilled grease rather than much higher structure in the milled grease, when compared to greases with much less rheopectic behavior. (4) These differences in the rheology of these seven greases must be due to only differences in the overbased calcium sulfonate used (Examples 7-10) and/or differences in the initial ratio of overbased calcium to overbased magnesium sulfonate when the DDBSA was added (Examples 11-13).

The next two examples use added glycerol derivative, as described in U.S. patent application Ser. No. 16/681,232 filed on Nov. 12, 2019, which claims the benefit of U.S. Provisional Application No. 62/769,704 filed Nov. 20, 2018. As is well known, milling is typically required in making a sulfonate-based grease. Although prior art sulfonate-based greases have a grease structure prior to milling, the milling step is required to achieve a smooth grease finish, impart some increase in thickening as evidenced by penetration value, and provide some further enhancement to the grease structural stability. However, as described in the '232 application, when a glycerol derivative is added, it is frequently not necessary to mill the grease as milling will not impart any additional benefits. In other words, when a glycerol derivative is added, the resulting greases are less rheopectic than typical sulfonate-based greases where a glycerol derivative is not added. In fact, in some embodiments of the glycerol derivative addition method, the unmilled grease has no measurable rheopectic behavior. To determine the impact on rheology of adding a glycerol derivative to an extremely rheopectic grease composition, Examples 14 and 15 add a glycerol derivative to the grease of Example 13.

Example 14—Another calcium-magnesium sulfonate complex grease was made almost identically to the previous Example 13 grease. The same good quality overbased calcium sulfonate was used in this Example 14 as was used in Examples 1, 7, and 13. The same overbased magnesium sulfonate was used. The same amounts and timing of all components were the same as Example 13, including a split addition of the overbased calcium sulfonate and a calcium sulfonate delayed addition. All other processing conditions were likewise the same. The only difference was that this grease had a glycerol derivative, hydrogenated caster oil (HCO), added just before heating the batch from ambient to conversion temperature. The HCO was added in an amount sufficient so that it was present at 1.0% in the final unmilled and milled greases. Example 13 was chosen as the baseline grease for the glycerol derivative addition examples since it exhibited the largest rheopectic behavior of any of the previous rheopectic greases. If pre-conversion addition of HCO has any effect on rheopectic behavior, it will be seen by using the Example 13 grease as a baseline.

Figure 8:
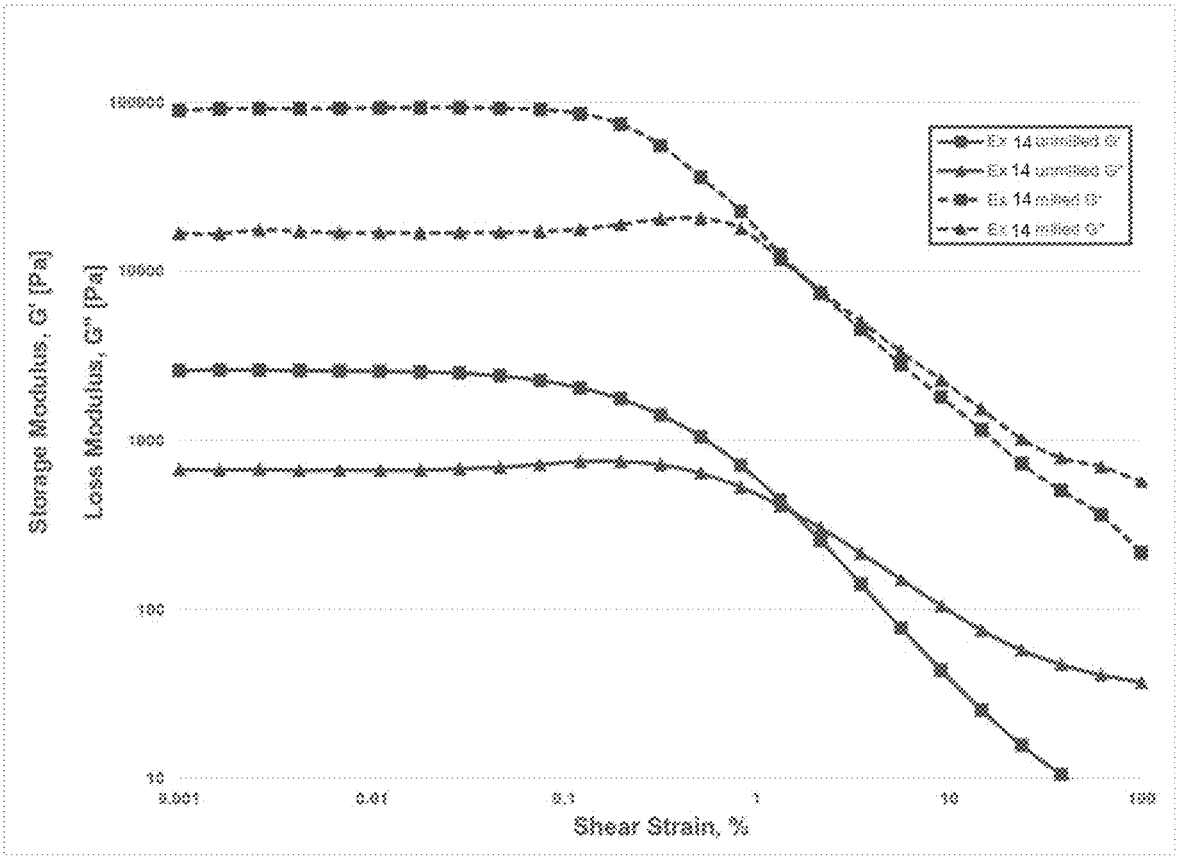
FIG. 8 is a graph showing results of an oscillatory rheometry amplitude sweep at 25 C of the Example 14 unmilled and milled greases.

The final unmilled grease had an unworked penetration of 451. The final milled grease had an unworked penetration of 241 and a worked 60 stroke penetration of 269. The dropping point was >650 F. The percent overbased calcium sulfonate was 30.9%. This grease was still very rheopectic, but not as rheopectic as the previous Example 13 grease. That fact is clearly seen by looking at the oscillatory rheometry results. FIG. 8 shows the results of the amplitude sweep at 25 C for the Example 14 grease. As can be seen, the Example 14 unmilled grease has a measurable grease structure, as shown by its G' and G" curves. The unmilled Example 13 grease (FIG. 7) had no detectable grease structure as shown by its G' and G" curves. Since the only difference between Example 13 and 14 is the pre-conversion addition of HCO, the HCO must be responsible for the increased structure of the Example 14 grease and the decrease in rheopectic behavior.

Example 15—Another calcium-magnesium sulfonate complex grease was made almost identically to the previous Example 14 grease. The same good quality overbased calcium sulfonate was used. The same overbased magnesium sulfonate was used. The same amounts and timing of all components were the same. All other processing conditions were likewise the same. The only difference was that this grease had twice the amount HCO added just before heating the batch from ambient to conversion temperature. The HCO was added in an amount sufficient so that it was present at 2.0% in the final unmilled and milled greases.

The final unmilled grease had an unworked penetration of 413 and a worked penetration of 345. The dropping point was 623 C. The final milled grease had an unworked penetration of 211 and a worked 60 stroke penetration of 251. The dropping point was >650 F. The percent overbased calcium sulfonate for both greases was 31.1%.

Figure 9:
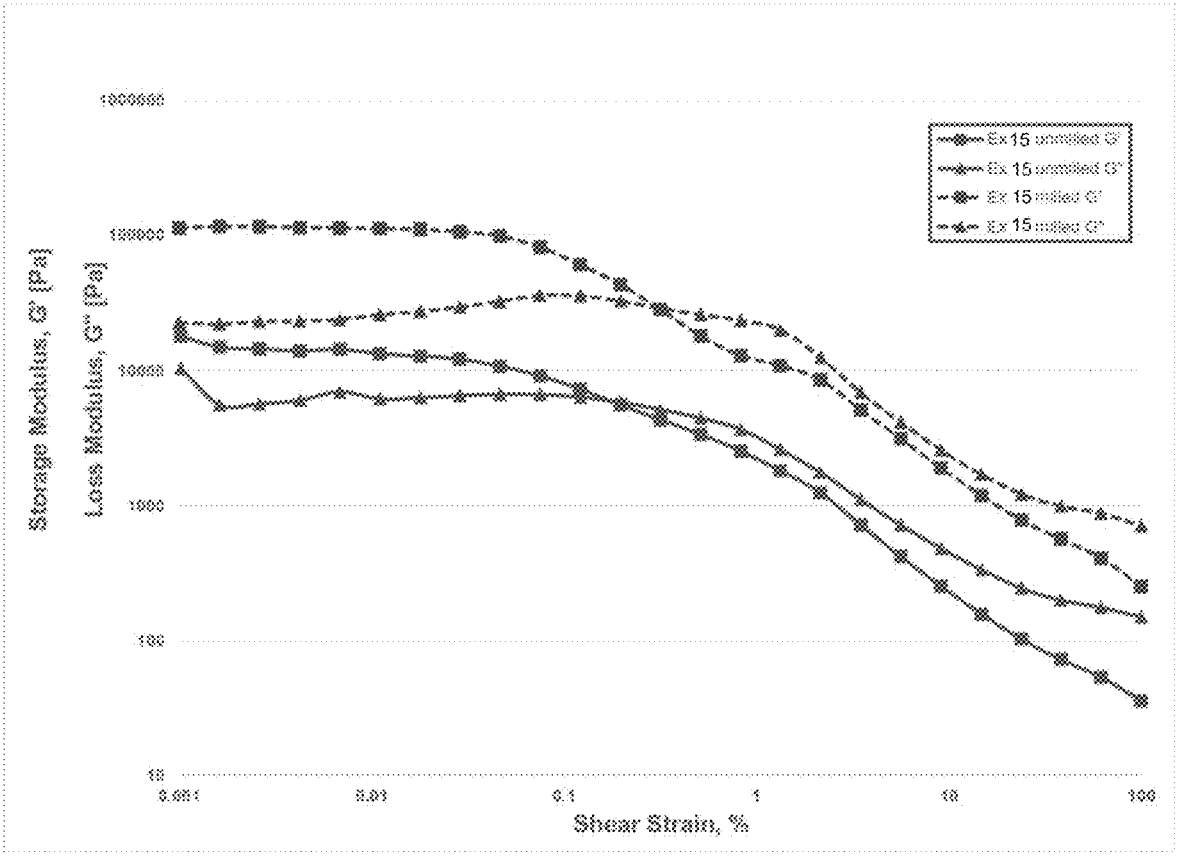
FIG. 9 is a graph showing results of an oscillatory rheometry amplitude sweep at 25 C of the Example 15 unmilled and milled greases.

This Example 15 grease was still very rheopectic, but not as rheopectic as the previous Example 13 or 14 greases. That fact is clearly seen by looking at the oscillatory rheometry results. FIG. 9 shows the results of the amplitude sweep at 25 C for the Example 15 grease. As can be seen, the Example 15 unmilled grease has a measurable grease structure, as shown by its G' and G" curves. The unmilled Example 13 grease (FIG. 7) had no detectable grease structure as shown by its G' and G" curves. The unmilled Example 14 grease (FIG. 8) did have a detectable grease structure as shown by its G' and G" curves. However, a comparison of FIGS. 8 and 9 clearly show that the pre-yield point modulus values of the Example 15 grease are much higher than those of the Example 14 grease. Likewise, the pre-yield point modulus values of the Example 14 grease are much higher than those of the Example 13 grease. Thus, as the concentration of the HCO increases, the rheopectic behavior of the resulting grease decreases.

A closer examination of the amplitude sweep data of Examples 13-15 provides further insight into the effect of the glycerol derivative on the calcium-magnesium grease structure. Table 8 provides the pre-yield point average modulus values for the Example 13-15 greases.

TABLE 8

Pre-Yield Point Average Modulus Values of Examples 13-15

| Grease | Ave G' (first 6 points) | Ave G" (first 6 points) | Ave G* (first 6 points) | Delta G' | Delta G" | Delta G* |
|---|---|---|---|---|---|---|
| Ex 13 unmilled | 39 | 36 | 53 | 55556 | 9188 | 56302 |
| Ex 13 milled | 55596 | 9224 | 56356 | | | |

TABLE 8-continued

| Pre-Yield Point Average Modulus Values of Examples 13-15 | | | | | | |
|---|---|---|---|---|---|---|
| Grease | Ave G' (first 6 points) | Ave G" (first 6 points) | Ave G* (first 6 points) | Delta G' | Delta G" | Delta G* |
| Ex 14 unmilled | 2595 | 671 | 2680 | 89691 | 16347 | 91162 |
| Ex 14 milled | 92286 | 17018 | 93842 | | | |
| Ex 15 unmilled | 14837 | 6803 | 16322 | 99163 | 16622 | 100060 |
| Ex 15 milled | 114000 | 23425 | 116382 | | | |

Several things can be noted from the Table 8 data: (1) Differences in rheology of these three greases are not due to the use of different overbased calcium sulfonates, as all three greases used the same overbased calcium sulfonate. (2) Differences in rheology of these three greases are not due to the use of different initial ratio of overbased calcium to overbased magnesium sulfonate when DDBSA was added with a split addition of overbased calcium sulfonate. All three greases used the same 1/1 ratio. (3) Differences in rheology can be due only to the addition of the glycerol derivative (HCO). Example 13 had 0% HCO; Example 14 had 1% HCO; Example 15 had 2% HCO. (4) Large increases in G', G", and G* for Examples 14 and 15 compared to Example 13 are caused by addition of HCO. This can be seen in both the unmilled and milled Example 14 and 15 greases. This means that even though all three greases were very rheopectic, the HCO is greatly increasing structure in the thickener portion and the base oil portion of the Example 14 and 15 greases when compared to the Example 13 grease. In fact, increases in overall grease structure upon milling (Delta G*) in the Example 14 and 15 greases are larger than any corresponding increase found in the greases of Table 7 where HCO was not used.

These results show that even when an ingredient that makes a typical sulfonate-based grease slightly less rheopectic is used, the use of the specific type of overbased calcium sulfonate and/or split and delay calcium sulfonate addition methods according to preferred embodiment of the invention will still result in an extremely rheopectic grease. By using the most rheopectic grease of all the examples (Example 13) as a baseline grease for the glycerol derivative addition Examples 14-15, the effect of the glycerol derivative can be easily seen. Typically, before a grease is milled, its thickener system is dispersed in a relatively less ordered configuration throughout the continuous phase (base oil and components dissolved in it) and it has a thickened grease structure. Mechanical milling provides increased dispersion and ordered structure to the thickener, resulting in a firmer grease consistency associated with normal rheopectic behavior for sulfonate-based greases. By using the most highly rheopectic grease formulation available (Example 13), the amount of ordered structure in the unmilled grease is extremely low. This is evidenced by the extremely low values of G', G", and G* for the unmilled Example 13 grease. Any effect imparted by the glycerol derivative to the structure pf the Example 13 grease will be obvious by looking at what happens to the G' and G" values when the glycerol derivative is added, which is exactly what the results of Table 8 show. The addition of HCO (as in Examples 14 and 15) is shown to add dispersion and ordered structure to the unmilled state, which is why milling is not necessary in most cases when making a sulfonate-based grease with added glycerol derivative as described in U.S. patent application Ser. No. 16/681,232 filed on Nov. 12, 2019, claiming the benefit of U.S. Provisional Application Ser. No. 62/769,704 filed Nov. 20, 2018. The added dispersion and ordered structure to the unmilled state is evident in by the increases in the G' and G" values of the unmilled Example 14 and 15 greases compared to the unmilled Example 13 grease. While both G' and G" significantly increase in the unmilled Example 14 and 15 greases compared to the unmilled Example 13 grease, the increase in G' is much larger. This proves that the HCO is dramatically increasing the ordered structure of the thickener portion of the unmilled Example 14 and 15 greases. Furthermore, this increase in the G' value is greater in Example 15 compared to Example 14. Thus, as the concentration of the HCO in the grease is increased, the amount of ordered structure in the unmilled grease increases. Of course, similar behavior in G' and G" can also be observed in the milled Example 14 and 15 greases compared to the milled Example 13 grease. However, all three Table 8 greases are extremely rheopectic. So, it is not surprising that the greatly increased ordered structure observed in the unmilled Example 14 and 15 greases (compared to the Example 13 grease) would be preserved when those greases were milled. However, these results show that an extremely rheopectic grease, requiring milling or shearing to take on a thickened grease structure, can still be achieved when adding a glycerol derivative to preferred embodiments of the invention herein.

The examples herein use added crystalline calcium carbonate as the sole added calcium containing based for reacting with complexing acids, as described in U.S. Pat. No. 9,273,265 (and further described in the '101, '102, '387, '388, and '391 patents). The same extreme rheopectic sulfonate-based greases would be expected, if the particular type of overbased calcium sulfonate is used and/or the split addition method and/or calcium sulfonate delayed addition methods are used, if one or more embodiments are used wherein calcium hydroxyapatite is used as a calcium containing base (as described in the '406 patent and further described in the '101, '102, '387, '388, and '391 patents, alone or in combination with one or more of added calcium carbonate, added calcium hydroxide, or added calcium oxide). To achieve the extremely rheopectic greases according to preferred embodiments when calcium hydroxyapatite is used, it is most preferred that all of the calcium hydroxyapatite be added after conversion, or only a small amount added prior to conversion.

Although the examples provided herein fall primarily in the NLGI No. 1, No. 2, or No. 3 grade, with No. 2 grade being the most preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base oil had been used so as to provide a No. 2 grade product, as will be understood by those of ordinary skill in the art.

While this invention deals primarily with greases made in open vessels, and the examples are all in open vessels, the complex calcium magnesium sulfonate grease compositions and methods may also be used in closed vessels where heating under pressure is accomplished. The use of such pressurized vessels may result in even better thickener yields than those described in the examples herein. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art.

Extremely rheopectic sulfonate-bases greases according to preferred embodiments of the invention may be particularly useful in several operating systems or types of equipment, including open gear systems, walking dragline (a.k.a. walking cam) machines, low or zero volatile organic compound (VOC) aerosol greases, any equipment that has a bulk lubrication system that uses small lines through which the grease must be pumped to the point where it is applied to the equipment that uses it, and any other application where there can be difficulty in getting the grease to the actual equipment, but shearing forces experienced within the equipment are sufficient to thicken the grease to its required consistency.

Open gear systems are heavily loaded and relatively slow moving. There are various ways to apply a lubricant in these systems. In some systems, there is a sump under the gearing, and the gears dip into the sump and bring some of the lubricant up into the gearing. In other systems, the lubricant is sprayed onto the gear faces under high pressure. A lubricant that is easily pumped or moved, such as an unsheared/unmilled extremely rheopectic sulfonate-based grease according to preferred embodiments of the invention, could be easily applied and would then quickly thicken to the required grease consistency to provide adequate lubrication. When an extremely rheopectic sulfonate-based grease is used in an open gear system that uses a sump to supply the grease to the gears, the high pressure shearing between the gears will cause the extremely rheopectic sulfonate-based grease composition to thicken into a grease-like structure. When an extremely rheopectic sulfonate-based grease is used in an open gear system that sprays the lubricant onto the gears, the high pressure spraying would by itself thicken the extremely rheopectic sulfonate-based grease composition to a grease-like consistency. Further thickening would also occur during the early high pressure shearing between the gears.

Walking dragline (a.k.a. walking cam) machines. The fluid nature of the unsheared/unmilled extremely rhepeoctic grease composition would make it easier to apply in walking dragline (or walking cam) machines. The heavy slow loading would thicken the extremely rheopectic grease composition to the right degree when properly formulated.

Greases can also be sold in aerosol cans. With current aerosol grease products, the grease is cut back with a highly volatile (quickly evaporating) organic solvent to thin the product out. This is necessary since a fully thickened grease (such as an NLGI No. 2 grade product) will not go through any spray can nozzle without plugging the nozzle. Then a propellant is added to the aerosol can with the cut-back grease. When a user presses the nozzle at the top of the can, the grease comes out with the solvent mixed in, the solvent evaporates, and the grease remains the surface to which it was applied. However, the cut-back solvents used in these aerosol products are typically are high in VOC, that are subject to environmental and use regulations in the U.S. and other countries. There are a few VOC exempt solvents that could be used in aerosol greases, but they are usually very expensive and are also usually incompatible with most greases, including calcium sulfonate greases. Because an unmilled/unsheared extremely rheopectic sulfonate-based grease according to preferred embodiments of the invention is already thin and fluid, it may be used in aerosol cans with significantly reduced amounts of cut back solvent or no solvent at all, thereby reducing or eliminating any VOC used. The high pressure nozzle of the aerosol can provides the required shearing force to change the extremely rheopectic sulfonate-based grease composition into a thickened grease. The extremely rheopectic sulfonate-based grease composition in an aerosol form avoids the need for expensive solvents and allows for a low or zero VOC aerosol grease.

Frequently, bulk lubrication systems have smaller diameter supply lines through which a grease is pumped to the point where it is applied to the equipment in need of lubrication. Such systems can encounter problems because an already thickened grease can be difficult to pump from a bulk storage tank to the point of use through small diameter supply lines, requiring larger pumps using more horsepower to move the grease to the desired end-use location. If the bulk storage tank and/or supply lines are outside or otherwise exposed to cold temperatures, these problems are more serious because the grease will be even harder to pump at colder temperatures. However, these problems can be avoided when using an unsheared/unmilled extremely rheopectic sulfonate-based grease according to preferred embodiments because it is sufficiently fluid when stored and pumped, making it easier to pump, even in colder temperatures. The extremely rheopectic grease composition will thicken to a grease structure once applied to the actual equipment that needs lubrication due to the shearing forces it experiences. For example, when applied to high speed and/or heavily loaded bearings, the extremely rheopectic grease is sheared immediately after entering the bearing and thickens to the required consistency. The unsheared/unmilled extremely rheopectic sulfonate-based grease compositions according to the invention may also be useful in any other application where there can be difficulty in getting the grease to the actual equipment, but shearing forces experienced within the equipment are sufficient to thicken the grease to its required consistency.

As used herein, a calcium sulfonate grease (or overbased calcium sulfonate grease) containing overbased magnesium sulfonate is sometimes referred to as a calcium magnesium sulfonate grease or an overbased calcium magnesium sulfonate grease. As used herein a "sulfonate-based grease" or an "overbased sulfonate-based grease" refers to a calcium sulfonate (or overbased calcium sulfonate) grease and/or a calcium magnesium sulfonate (or overbased calcium magnesium sulfonate) grease. As used herein: (1) quantities of dispersed calcium carbonate (or amorphous calcium carbonate) or residual calcium oxide or calcium hydroxide contained in the overbased calcium sulfonate are by weight of the overbased calcium sulfonate; (2) some ingredients are added in two or more separate portions and each portion may be described as a percentage of the total amount for that ingredient or a percentage of final grease by weight; and (3) all other amounts (including total amounts) of ingredients identified by percentages or parts are the amounts added as an ingredient by weight of the final grease product, even though the particular ingredient (such as water, or calcium-containing bases or alkali metal hydroxides that react with other ingredients) may not be present in the final grease or may not be present in the final grease in the quantity identified for addition as an ingredient.

As used herein "added calcium carbonate" means crystalline calcium carbonate that is added as a separate ingredient in addition to the amount of dispersed calcium carbonate contained in the overbased calcium sulfonate. As used herein "added calcium hydroxide" and "added calcium oxide" means calcium hydroxide and calcium oxide, respectively, that are added as a separate ingredient in addition to the amount of residual calcium hydroxide and/or calcium oxide that may be contained in the overbased calcium sulfonate. As used herein to describe the invention (as opposed to how the term is used in some prior art references), calcium hydroxyapatite means (1) the compound having the formula $Ca_5(PO_4)_3OH$ or (2) a mathematically equivalent formula (a) having a melting point of around 1100 C or (b) specifically excluding mixtures of tricalcium phosphate and calcium hydroxide by such equivalent formula. As used herein, "penetration value" refers to a 60 stroke worked penetration value, unless otherwise specifically noted.

As used herein, the term "thickener yield" as it applies to the subject invention shall be the conventional meaning, namely, the concentration of the highly overbased oil-soluble calcium sulfonate required to provide a grease with a specific desired consistency as measured by the standard penetration tests ASTM D217 or D1403 commonly used in lubricating grease manufacturing. As used herein, "penetration value" refers to a 60 stroke worked penetration value, unless an unworked penetration value is specifically described. In like manner, as used herein the "dropping point" of a grease shall refer to the value obtained by using the standard dropping point test ASTM D2265 as commonly used in lubricating grease manufacturing. Four Ball EP tests as described herein shall refer to ASTM D2596. Four Ball Wear tests as described herein shall refer to ASTM D2266. Cone Oil Separation tests as described herein shall refer to ASTM D6184. Roll Stability tests as described herein shall refer to ASTM D1831. As used herein, "non-aqueous converting agent" means any conventional converting agent other than water and includes such conventional converting agents that may contain some water as a diluent or an impurity. All amounts for ingredients or ratios of ingredients indicated herein as a range include each individual amount or ratio within those ranges and any and all subset combinations within ranges, including subsets that overlap from one preferred range to a more preferred range. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

We claim:

1. A method for making an extremely rheopectic sulfonate-based grease, the method comprising the steps of:

adding an overbased magnesium sulfonate;

adding a facilitating acid;

adding water;

adding an overbased calcium sulfonate having amorphous calcium carbonate dispersed therein according to one of the following steps:

(A) adding all of the overbased calcium sulfonate after the adding the overbased magnesium sulfonate step and after the adding the facilitating acid step or (B)(1) adding a first portion of the overbased calcium sulfonate (i) prior to, during, or after the adding the overbased magnesium sulfonate step and (ii) prior to the adding the facilitating acid step and (2) adding a second portion of the overbased calcium sulfonate after the adding the facilitating acid step;

converting a first mixture comprising the overbased magnesium sulfonate, the facilitating acid, at least a first portion of the water, and the overbased calcium sulfonate to a converted mixture by heating until conversion of the amorphous calcium carbonate dispersed in the overbased calcium sulfonate to a crystalline form has occurred; and wherein the extremely rheopectic sulfonate-based grease comprises a fluid-like and pumpable consistency after the converting step and only takes on a grease-like consistency after milling or shearing.

2. The method of claim 1 further comprising one or more calcium sulfonate delay periods between the adding the facilitating acid step and the adding the overbased calcium sulfonate step, wherein the one or more calcium sulfonate delay periods comprise:

(1) a calcium sulfonate holding delay period, where a mixture comprising the facilitating acid is held at a temperature or range of temperatures for a period of time prior to adding all of the overbased calcium sulfonate according to the adding the overbased calcium sulfonate step (A) or prior to adding the second portion of the overbased calcium sulfonate according to the adding the overbased calcium sulfonate step (B), or (2) a calcium sulfonate temperature adjustment delay period, where the mixture comprising the facilitating acid is heated or cooled to a temperature or range of temperatures prior to adding all of the overbased calcium sulfonate according to the adding the overbased calcium sulfonate step (A) or prior to adding the second portion of the overbased calcium sulfonate according to the adding the overbased calcium sulfonate step (B), or (3) a combination thereof.

3. The method of claim 1 further comprising:

adding a conventional non-aqueous converting agent;

wherein there is a converting agent delay period between the adding the water step wherein the first portion of water is added and the adding the conventional non-aqueous converting agent step; and wherein the converting agent delay period comprises:

(1) a converting agent holding delay period wherein a mixture comprising the first portion of water is maintained at a temperature or within a range of temperatures for a period of time of at least 20 minutes prior to the adding the conventional non-aqueous converting agent step wherein at least a first portion of the conventional non-aqueous converting agent is added, or (2) a converting agent temperature adjustment delay period where the mixture comprising the first portion of water is heated prior to the adding the conventional non-aqueous converting agent step wherein the at least the first portion of the conventional non-aqueous converting agent is added, or (3) a combination thereof.

4. The method according to claim 3 wherein the non-aqueous converting agent comprises a glycol, a glycol ether, a glycol polyether, or a combination thereof.

5. The method according to claim 4 wherein the glycol is hexylene glycol or propylene glycol.

6. The method of claim 1 wherein the overbased calcium sulfonate comprises (1) benzene rings comprising more than one alkyl group; (2) a natural calcium sulfonate; (3) benzene rings that are sterically hindered, (4) or a combination thereof.

7. The method of claim 1 wherein the adding the overbased calcium sulfonate step is step (A).

8. The method of claim 1 wherein the adding the overbased calcium sulfonate step is step (B).

9. The method of claim 1 further comprising heating the converted mixture to a temperature sufficiently high to substantially remove the water; and wherein the extremely rheopectic sulfonate-based grease comprises a fluid-like and pumpable consistency after the converting step and only takes on a grease-like consistency after milling or shearing.

10. The method of claim 1 wherein the extremely rheopectic sulfonate-based grease has an unmilled, unworked penetration greater than 360.

11. The method of claim 1 wherein the extremely rheopectic sulfonate-based grease has an unmilled, unworked penetration greater than 400.

12. The method of claim 3 wherein the extremely rheopectic sulfonate-based grease has an unmilled, unworked penetration greater than 450.

13. The method of claim 1 wherein the extremely rheopectic sulfonate-based grease has an unmilled worked 60 stroke penetration value and an unmilled unworked penetration, wherein the unmilled worked 60 stroke penetration is less than the unmilled unworked penetration value.

14. The method of claim 1 wherein the extremely rheopectic sulfonate-based grease has an unmilled worked 60 stroke penetration value and a unmilled unworked penetration, wherein the unmilled worked 60 stroke penetration is less than the unmilled unworked penetration value by at least 20 points.

15. The method of claim 1 wherein the extremely rheopectic sulfonate-based grease has an unmilled worked 60 stroke penetration value and a unmilled unworked penetration value, wherein the unmilled worked 60 stroke penetration is less than the unmilled unworked penetration value by at least 50 points.

16. The method of claim 1 wherein the extremely rheopectic sulfonate-based grease is Newtonian prior to milling or shearing.

17. The method of claim 1 further comprising:

packaging the extremely rheopectic sulfonate based grease having the fluid-like and pumpable consistency in an aerosol can comprising a nozzle;

wherein the aerosol can is configured to apply shearing forces to the extremely rheopectic sulfonate-based grease so that it takes on the grease-like consistency after dispensing through the nozzle.

18. The method of claim 17 wherein the wherein the aerosol can does not contain any VOC-containing solvents.

19. The method of claim 1 further comprising heating the converted mixture to a temperature to substantially remove the water; and wherein the extremely rheopectic sulfonate-based grease comprises a fluid-like and pumpable consistency after the converting step and only takes on a grease-like consistency after milling or shearing.

20. The method of claim 7 wherein the overbased calcium sulfonate is a good quality overbased calcium sulfonate.

21. The method of claim 8 wherein the overbased calcium sulfonate is a good quality overbased calcium sulfonate.

22. The method of claim 2 wherein the overbased calcium sulfonate is a good quality overbased calcium sulfonate.

23. The method of claim 2 further comprising:

adding a conventional non-aqueous converting agent;

wherein there is a converting agent delay period between the adding the water step wherein the first portion of water is added and the adding the conventional non-aqueous converting agent step; and wherein the converting agent delay period comprises:

(1) a converting agent holding delay period wherein a mixture comprising the first portion of water is maintained at a temperature or within a range of temperatures for a period of time of at least 20 minutes prior to the adding the conventional non-aqueous converting agent step wherein at least a first portion of the conventional non-aqueous converting agent is added, or (2) a converting agent temperature adjustment delay period where the mixture comprising the first portion of water is heated prior to the adding the conventional non-aqueous converting agent step wherein the at least the first portion of the conventional non-aqueous converting agent is added, or (3) a combination thereof.

24. The method of claim 23 wherein the overbased calcium sulfonate is a good quality overbased calcium sulfonate.

* * * * *